United States Patent [19]

Mitamura et al.

[11] 4,157,728

[45] Jun. 12, 1979

[54] PROCESS FOR DIRECT CHILL CASTING OF METALS

[75] Inventors: Ryota Mitamura, Yokohama; Tadanao Itoh, Ichihara, both of Japan

[73] Assignee: Showa Denko Kabushiki Kaisha, Tokyo, Japan

[21] Appl. No.: 820,535

[22] Filed: Jul. 29, 1977

[30] Foreign Application Priority Data

| | | | |
|---|---|---|---|
| Jul. 29, 1976 | [JP] | Japan | 51-89620 |
| Mar. 18, 1977 | [JP] | Japan | 52-29328 |
| Jun. 24, 1977 | [JP] | Japan | 52-77474 |

[51] Int. Cl.[2] ..... B22D 11/12; B22D 11/16

[52] U.S. Cl. ..... 164/4; 164/73; 164/66; 164/124; 164/126

[58] Field of Search ..... 164/4, 73, 414, 443, 164/348, 356, 147, 66, 268, 124, 126

[56] References Cited

U.S. PATENT DOCUMENTS

| | | | |
|---|---|---|---|
| 3,329,200 | 7/1967 | Craig | 164/268 |
| 3,702,155 | 11/1972 | Getselev | 164/251 |
| 3,773,101 | 11/1973 | Getselev | 164/251 |
| 4,004,631 | 1/1977 | Goodrich et al. | 164/250 |

FOREIGN PATENT DOCUMENTS

| | | | |
|---|---|---|---|
| 50-27807 | 9/1975 | Japan | 164/147 |
| 233228 | 10/1944 | Switzerland | 164/443 |
| 508332 | 5/1976 | U.S.S.R. | 164/147 |

*Primary Examiner*—Robert L. Spicer, Jr.
*Attorney, Agent, or Firm*—Armstrong, Nikaido, Marmelstein & Kubovcik

[57] ABSTRACT

A direct chill casting of metals, particularly hot top casting of aluminum and its alloy, is improved by applying a gas pressure to the metals from directly below the overhang of a feed reservoir for receiving a melt to be cast.

The direct chill casting is further improved by supplying a lubricating oil from a slit for conveying the gas to the inner wall of the mold.

By using the process and the apparatus according to the invention, ingots having excellent smooth surfaces and reduced segregation can be reliably produced with a reduction in the amount of the lubricating oil used.

18 Claims, 21 Drawing Figures

PROCESS FOR DIRECT CHILL CASTING OF METALS

The continuous casting process is generally used for producing most ingots, which are the starting materials of the plastic working of metals and alloys, such working consisting of rolling and extrusion processes. The direct chill casting process, wherein the vertical, fixed mold is employed, is particularly widely applied to the continuous casting of nonferrous metals. In this direct chill casting process, the nonferrous metallic melt is poured into a water-cooled mold, through a floating distributor, which distributor has such purposes as that of maintaining a constant level of molten metal in the mold and also that of uniformly distributing the stream of molten metal into the mold. The heat of the molten metal is extracted through the wall of the mold, for cooling and solidifying the outer part of the molten metal into a shell, and then this shell is continuously injected with water at a location directly below the mold for cooling and solidifying the inner part of the molten metal. The solidified ingot is withdrawn downwardly until a predetermined length between the bottom of the ingots and the molds is obtained, and then the casting is interrupted. The ingot is thereafter lifted upwards.

However, the above-mentioned direct chill process is disadvantageous because the floating distributor can not operate smoothly, with the result being that the level of the molten metal fluctuates or varies during the casting process, and thereby a defective cast surface of the ingot is produced. Due to the fluctuation or variation of the level of the molten metal, some surface defects, namely cold shut, ripple, oxide film inclusion, etc., will occur. Furthermore, the alloying elements of the cast metal are inversely segregated to a large extent in the surface layer of the ingot. Accordingly, the inversely segregated surface must be removed by machining considerably deeply into the surface, prior to the plastic working of the ingot. The above-mentioned process is also disadvantageous for carrying out the so-called multistrand casting, wherein a number of molds are adjoined to a single tapping trough of the melting furnace. This is because a plant attendant is required to correct the floating distributors prior to the start of casting and to monitor the operation, of such distributors during the casting process. It is therefore difficult to economically reduce the labor force required in the conventional direct chill casting.

It is reported in the "Journal of Metals", published in 1971, October, on pages 38 and 39, that a process had been developed in the U.S.S.R. for preventing the occurrences of surface defects and inverse segregation. According to the Russian developed process, an electromagnetic field is generated in the region of the water-cooled mold, thereby bringing the melt not into contact with the mold. Furthermore according to the same process, the cooling of the melt is accomplished by the direct water-cooling of the melt. This process has the following disadvantages: Firstly, the required generation of the electromagnetic field is very costly; secondly, the distance between adjacent molds must be enlarged so as to prevent the influence of the electromagnetic field from occurring between the molds; thirdly, the meniscus surface of the melt must be stationary and maintained to a strictly determined, constant height so as to prevent the cast surface from becoming a undulation on the surface; and fourthly, the degree of roundness of the round ingot is rather poor.

In recent years, one of the greatest progresses in the field of continuous casting of nonferrous metal resides in the so-called hot top casting, wherein the melt which exhibits a high hydrostatic pressure is held above the solidifying layer of the metal. Since the level of the melt is, according to this process, located in a feed reservoir of melt, it is not required to strictly adjust the height of the melt surface within the mold by means of the floating distributor.

Accordingly, because a plant attendant is not necessary for monitoring the level of the melt surface, the work force required for carrying out the process can be economically reduced. Although this hot top process can also be used to advantageously reduce the incorporation of oxide films into the melt being solidified, the process is not said to be a complete technique, especially from the point of view of obtaining an improved cast surface.

Disclosed in the U.S. Pat. No. 3,381,741 is a continuous casting apparatus, wherein a chamber for holding a body of molten metal with a heat insulative refractory member is provided adjacent the mold and has an opening therein for the passage of molten metal from the chamber into the mold, and wherein a relatively thin heat conductive insert at the mold entry and in contact with the mold and the heat insulative member has an inside surface substantially parallel to the mold axis and extends around the entire mold opening and disposed slightly laterally inwardly of, and substantially conforms to the general shape of, the remaining inside surface of the mold.

In addition, a liquid lubricating oil is continuously supplied from the top of the mold. Since the chamber for holding the melt is protruding inwardly relative to the insert, the melt is brought sufficiently into contact with the mold for suppressing the variation in the surface tension of the melt at its contacting portion. In addition, the insert enables the melt to be preliminarily cooled so that the second cooling by the mold is decreased, thereby achieving an improvement in the cast surface. However, this process is disadvantageous, because the quality of the cast surface is critically influenced by the material and dimension of the insert. Furthermore, because a very large amount of lubricating oil is required for obtaining a smooth cast surface, the drainage system of the casting plant becomes polluted by a component contained in the lubricating oil, for example, N-hexane.

A casting apparatus is disclosed in the U.S. Pat. No. 3,612,151, wherein an overhang of the feed reservoir for the melt does not exceed one-eighth of an inch (3.175 mm) over the mold face, and wherein the casting speed is so adjusted that the solidification of a front end of the melt is controlled to a particular position relative to the casting direction. According to the disclosed controlling method, the ripple on the cast surface due to the excessive heat diffusion through the mold can be prevented. In addition, liquation on the cast surface can be prevented, whereas in the conventional continuous casting process the melt is forced to flow through the thin weak part of the shell and inevitably causes liquation when the lubricating agent is excessively used, thus reducing the heat transfer through the mold. However, the solidified shell is weakened when casting an alloy such as one containing a large amount of alloying elements, for example, an alloy designated as 2014 alloy in the AA Standard. When alloys having a weak shell are cast by using the disclosed process in the U.S. Patent, a cast surface having a wide ripple or an under-surface segregation in the longitudinal direction of the ingot may be formed during the withdrawal of the ingot from the mold.

It is disclosed in the German Laid-Open Patent Specification No. 2452672 that the relationship between each of the lengths of the mold, the level of the melt in the feed reservoir and the casting speed is appropriately determined to enable the obtaining of an excellent cast surface. In the disclosed process, the combination of the short mold and the shallow depth of the melt is particularly suited for removing the defects of the cast surface. The short mold is, however, critically affected by the variation of the cooling condition for the melt, and therefore the danger of "bleed out", i.e. leakage of the melt through a broken, incompletely solidified surface of the ingot, is increased by use of the short mold. The shallow bath is also disadvantageous because during the multi strand casting process such a bath requires a strict control of the level of melt within the plurality of molds by carefully supplying the melt into the molds.

It is therefore an object of the present invention to provide an improved process for the direct chill casting, hereinafter referred to as the basic process.

It is also an object of the present invention to provide an improved hot top casting process for producing an excellent cast surface, which process can also be utilized to reduce the labor requirements involved, as previously mentioned.

It is an object of the present invention to further improve the above-mentioned basic process so that metal penetration can be prevented from occurring in every kind of aluminum alloys. The Inventors discovered that metal penetration, which, in the art, means metal penetrating into the supplying channels of the lubricating oil and which causes a defective cast surface such as that with scratched flaws, took place when particular kinds of aluminum metals were cast by using the basic process of the present invention.

It is a further object of the present invention to provide an apparatus for the hot top casting wherein the above-mentioned disadvantages are removed. This apparatus is hereinafter referred to as the basic apparatus.

It is another object of the present invention to improve the above-mentioned basic apparatus provided by the present invention, so that there is no further need for grinding the inner wall of the mold after a long period of use. The Inventors discovered that unless the inner wall was ground, the lubricating oil could not flow through the oil channels due to the sticking of foreign matters onto the channels for the lubricating oil.

It is still another object of the present invention to provide an automatic controlling process for the basic process according to the invention. The automatic controlling process was discovered to be essential for carrying out the basic process on an industrial scale, after the Inventors encountered, particular difficulties, which impeded the industrial employment of the basic process as illustrated hereinbelow, The above-mentioned particular difficulties encountered during casting on an industrial scale were as follows.

A. The parameters P, V and Q described below can be varied even after the start of casting.

The applied gas-pressure in terms of P(mm$H_2O$) compared with the hydrostatic pressure of the melt, the flowing rate of gas (V, l/minute), and the supplying rate of the lubricating oil (Q, ml/minute) can vary over the ranges predetermined for P, V and Q and thus cause the casting operation to fail. In the direct chill casting on an industrial scale, a melt is necessarily poured simultaneously into a number of molds to produce a plurality of strands in the form of billets or slabs. It is not easy or practical to precisely adjust the parameters, P, Q and V with regard to each of the molds. If this control is assigned to plant attendants, an increased number of attendants must be engaged in the manual operation of the parameters, thereby creating an economic disadvantage in terms of achieving a labor reduction.

B. The control of the parameters P, V and Q can frequently be unsuccessful at the start of casting, particularly when the casting speed is high. It was discovered by the Inventors that, in order to achieve an excellent cast surface, the gas-flowing rate V should be at a relatively low level when the casting speed is low.

According to our discovery, in the case of casting of six-inch billet of 6063 AA Standard aluminum alloy, the gas-flowing rate V should be as low as 1.0 for obtaining the required effects of the applied gas-pressure from the start of casting. However, if the gas-flowing rate V is further lowered to 0.5, the gas pressure P cannot be elevated to the predetermined value during and after the start of casting. In the case where P is not elevated, even a gradual increase of V can not increase P to its predetermined value. P is not elevated, because of the reasons stated hereinbelow: flaws in the form of longitudinal lines were formed due to supercooling during the initial casting period and clearances were thus formed between the surfaces of the solidified metal and the inner wall of the mold, which clearances being discontinuous to one another when seen from the circumferential direction of the mold; and the resistance to the passage of air between the metal and the mold is considerably reduced, with the leakage of air through the clearances being increased to a great extent. When the leakage phenomenon occurs, a considerable increase of V occuring after the leakage will no longer result in the increase of P, with the result being that a smooth cast surface, obtained during when a pertinent gas pressure is being maintained, is not provided.

It is, therefore, also an object of the invention to provide an automatic control process for casting, wherein the disadvantages recited in Item A, above, can be removed by automatically maintaining the predetermined casting parameters during a steady stage of casting, at which the gas pressure usually exhibits relatively small variations and wherein the disadvantages recited in Item B, above, can be removed by automatically correcting the variations of the casting parameters during the unstable stage at the start of casting, at which stage the gas pressure varies exceedingly.

In accordance with the present invention, there is provided the basic process, for direct chill casting of metals in a forced-cooling mold comprising the steps of: storing a metallic melt in a feed reservoir for the melt, above and adjacent the mold, the feed reservoir having an overhang over the inner wall of the mold; forming a lubricating surface essentially over the entire inner wall of the mold; feeding said melt from said feed reservoir into the mold; holding a body of the metal within the mold; and passing a cooling agent through the mold thereby performing the forced-cooling of the metal body; an improvement which comprises the steps of: introducing a gas from directly below the overhang and applying gas pressure on the peripheral surface of the metal body at the part of the metal body directly below the overhang.

According to an embodiment of the basic process, wherein the improved cast surface of the ingot is reliably produced, the gas pressure is predetermined between the pressure at which the gas ascends through the metallic melt and the pressure at which the area contact of the metal body with the inner wall of the mold is substantially reduced due to the introduction of the gas.

According to another embodiment of the basic process, wherein the improved cast surface of the ingot is more reliably produced, the gas pressure is predetermined to be approximately equal to the hydrostatic pressure of the melt at a depth thereof equal to the overhang.

When aluminum or its alloy is cast, it is preferable that formation of the lubricating surface is performed by supplying a liquid lubricating agent to the inner wall of the mold.

According to a further embodiment of the basic process, wherein the most advantageous combination of the lubrication and the gas pressure applied to the metal from directly below the overhang is provided, the lubricating oil is supplied to the inner wall of the mold at a position on the mold below the introduction position of the gas. In addition, the pressure for supplying the lubricating oil is such that this oil does not flow back due to gas pressure. Still further, the viscosity of the lubricating oil ranges from 1 to 50 poises, preferably from 5 to 40 poises, at room temperature.

The supplying pressure of the lubricating oil is adjusted by using an oil-pump or a reservoir of oil having a pertinent head pressure. This adjustment is performed by taking into consideration the resistance of the channel for supplying the oil, the viscosity of oil, the dependence of this viscosity on the temperature of the oil, etc., so that the pressure of the oil at the outlet ends of the channels is adequate.

The supplying rate of the oil is dependent on the introduction rate of the gas. The preferable former rate ranges from 0.2 to 5.0 milliliters/minute, preferably, 0.1 to 1.2 milliliters/minute when the latter rate varies from 1.0 to 3.0 liters/minute.

In still another embodiment of the basic process, the gas used is at least one gas selected from the group consisting of air, nitrogen and an inert gas.

In accordance with the object for further improving the above-mentioned basic processes according to the invention, there is provided a process, which further comprises the step of: supplying the lubricating oil on an inner peripheral part of the top surface of the mold and subsequently to the inner wall of the mold. This process is, hereinafter, referred to as the process maintained under an improved supply of lubricating oil.

The ingots to be cast according to the processes of the present invention include a round ingot, usually referred to as a billet, and subjected to shaping by extrusion or drawing; a rectangular ingot, usually referred to as a slab and subjected to shaping by rolling the same into a sheet; and a thick-walled, hollow ingot subjected to extrusion for shaping the same into tubes and into hollow articles similar to such tubes.

The processes according to the invention are an improved, direct chill casting process, in which the metallic melt is held in a pillar or tubular form in the mold adjacent to the mold. According to the current knowledge of the direct chill casting, the following assumptions can be made with regard to the casting mechanism: the circumference of the melt, which is brought into contact with the inner surface of the forced-cooling mold, is rapidly cooled and the thin, solidified shell is formed on such part; thereafter, the solidified shell becomes thicker and correspondingly shrinks. Accordingly, the solidified shell shrinks and is separated from the circumferential surface of the mold. Furthermore, the solidification of the melt begins from the part of the melt adjacent to the inlet of the mold.

Thereafter, gas pressure is applied, according to the improvement of the present invention, onto the outer peripheral surface of the cast metallic body which is directly below the overhang. The gas can, for example, be directed from a direction perpendicular to the axial direction of the cast body and in a direction parallel to the lower end of the basin for receiving the melt with such lower end forming the overhang. When the gas is introduced in these above-mentioned directions, the gas is introduced through the interface between the feed reservoir for receiving the melt and the mold. Furthermore, the gas is introduced into one or more regions of this interface and then distributed around the entire interface, and finally caused to arrive through the entire interface at the outer peripheral surface of the metal in a pillar or tubular form. Namely, it is not disadvantageous at all for a partial flow of the gas, which is caused to flow obliquely with respect to the outer circumferential surface, to be present in the gas flow. All of the gas can naturally be introduced in an essentially perpendicular direction which is perpendicular to the peripheral surface of the metal. The introduction of the gas is performed in such a manner that the introduction process is continued over the entire period of the casting. Furthermore, gas is distributed around the entire surface of the metal. Gas can pass along any passage provided that the gas arrives at a predetermined height of the metal body. It is, however, reasonable, from a practical point of view, to cause the gas to flow along the passage at the interface mentioned above.

The casting is performed, according to the present invention, under the conditions of establishing the lubricating surface on the inner surface of the mold.

The method of establishing the lubricating surface can be one of the following known methods, (1) through (3), wherein:

(1) The liquid lubricating oil is caused to exude continuously toward the inner surface of the mold, at a position below the overhang.

(2) The lubricating agent is applied on the inner surface of the mold, prior to the initiation of the casting.

(3) The material for constituting the mold is so selected that the material possesses both (a) a large contact angle with respect to the molten metal and (b) self-lubricating effects with respect to the solidified shell of the metal such as, for example, the self-lubricating effects possessed by graphite.

The above-mentioned processes (1) and (2) are applicable for lubricating the inner wall of a mold made of an excellent heat conductive material, such as a coopermold or an aluminum-mold.

CONTROL PROCESSES

In accordance with the invention, there is provided a first control process, which, in addition to the basic process, comprises the steps of: flowing the gas at a predetermined rate; flowing the lubricating agent at a predetermined rate; detecting the temperature of the inner wall of the mold; increasing at least the rate of flowing the gas (out of both the rate of flowing the gas and the rate of supplying the lubricating agent) to a rate higher than the predetermined rate, when the detected temperature of the inner wall of the mold exceeds a predetermined temperature.

According to the first control process, the temperature of the inner wall of the mold, preferably the upper part of the inner wall, is detected by a suitable means. The gas-pressure exerted on the melt is, according to the feature of the first control process, maintained within a pertinent range by monitoring the detected temperature. The predetermined temperature of the inner wall varies depending on the temperature of the melt, the casting speed and the temperature and amount of cooling water in the mold. This predetermined temperature is within the range of from 20° to 50° C. more usually from 25° to 40° C. When casting conditions such as the melt temperature, the casting speed, etc., are concretely determined, the temperature of the mold is monitored to fall within the upper- and lower-control limits, which are determined to be about 5° C. higher and lower than the above-mentioned, predetermined temperature. In other words, when the predetermined temperature is, for example, 25° C., and when the temperature of the inner wall of the mold exceeds 30° C., the step of increasing the flowing rate of air and, occasionally, of increasing both the air-and lubricating oil-flowing rates is initiated. The first control process is suitable for effecting a pertinent casting during the above-mentioned, steady casting stage.

In accordance with the invention, there is provided a second control process, which, in addition to the basic process, further comprises the steps of: flowing the gas at a predetermined rate; flowing the lubricating agent at a predetermined rate; detecting the temperature of the inner wall of the mold and the pressure of the gas at a position directly below the overhang; increasing at least the rate of flowing the gas (out of both the rates of flowing the gas and the rate of supplying the lubricating agent) to a rate higher than the predetermined rate, when the detected temperature of the inner wall of the mold exceeds a predetermined temperature; increasing at least the rate of flowing the gas (out of both the rate for flowing the gas and the rate of supplying the lubricating agent) to a rate higher than the predetermined rate, when the detected pressure exceeds a predetermined upper pressure; and decreasing the increased rate to a rate lower than the predetermined rate, when the detected pressure decreases from a predetermined lower pressure.

According to the second control process, the pressure of gas directly below the overhang in addition to the temperature of the mold-inner wall is measured. The standard pressure of gas directly below the overhang is varied depending on the length of the overhang, the kinds of melt, the casting speed, etc. When the overhang is from 10 to 20 mm in length, the gas pressure directly below the overhang should then be not less than the hydrostatic pressure of the melt by an amount of $-15$ mm $H_2O$ and should also be not greater than the hydrostatic pressure of the melt by an amount of $+15$ mm $H_2O$ the hydrostatic pressure being determined at a depth corresponding to the level of the overhang.

In both the first and second control processes, it is required to at least adjust the air-introduction rate (V) out of both the rate (V) and the supplying rate of the lubricating agent (Q). Namely, when the casting conditions can still not yet be stabilized by adjusting the air-introduction rate (V), it is necessary to additionally adjust the supplying rate of the lubricating agent (Q). In other words, when neither the temperature of the inner wall of the mold nor the pressure of the gas can be increased by increasing the gas-introduction rate, the adjustment, i.e. increase of both rates (V) and (Q) is performed to obtain the predetermined temperature and pressure. The necessity for adjusting both rates (V) and (Q) arises during the initial casting period. The reasons for why the additional adjustment of the lubricating agent is effective for increasing the inner wall-temperature and the gas pressure from directly below the overhang are not completely elucidated. However, it is supposed that the clearance between the inner wall of the mold and the outer surface of the solidifying metal are either sealed or diminished by the liquid lubricating oil, with the result being that the resistance of the passage of gas is increased.

It is preferable to abruptly increase the rates V and Q to two to three times as much as the predetermined rates of Vo and Qo, respectively, when the rates V and Q are to be adjusted.

It is preferable not to abruptly decrease the rates V and Q to the rates Vo and Qo, but to gradually decrease the rates V and Q when the temperature of the inner wall of the mold and the gas pressure directly below the overhang have both returned to the predetermined values.

The temperature of the inner wall of the mold can exceed but cannot usually decrease from the predetermined temperature at the start and during the period of steady casting. The inner wall-temperature can, however, be decreased to the predetermined value (1) when the depth of the melt in the feed reservoir is decreased due to the interruption of the melt-pouring process at the final period of casting, or (2) when the melt can no longer flow into the mold, because the melt in the reservoir rarely solidifies due to some unknown reasons. In the case of (1), above, concerning a decrease in the inner wall temperature of the mold, it is advisable to interrupt the gas-introduction and the supply of the lubricating agent, when a signal, which indicates the end of the casting operation and which is generated by some suitable means, is detected by an appropriate means. In the case of (2), above, concerning a decrease in the inner wall temperature of the mold, it is advisable to stop the casting operation, such as the lowering operation of the bottom plate for supporting the ingot and the pouring operation of melt, wherein this stop operation is interlocked when an abnormal incident as suggested in Item (2), above, is detected by a warning lamp.

APPARATUS

In accordance with the present invention, there is provided a basic apparatus, which comprises:

an open ended heat-conductive mold for defining a mold space and for performing forced-cooling of the metallic melt, and an open-ended refractory feed reservoir for holding the metallic melt and for feeding the melt into the mold, such feed reservoir being located above and adjacent the mold and having an overhang over the inner wall of the mold;

such apparatus further comprising:

an annular gas-tightly engaged region and an annular slit region both located between the mold and the feed reservoir, such slit region being circumferentially surrounded from outside by the gas-tightly engaged region, the slit region being communicated with the mold space, and the dimension of the slit being such that the melt does not penetrate thereinto, and a gas source communicated to the slit through a passage or passages provided in the mold.

According to an embodiment of the basic apparatus, suitable for casting an aluminum and its alloy, wherein the mold is provided therein with channels for supplying a lubricating oil to the inner wall, the channels being uniformly arranged over the inner wall of the mold, and open ends of the channels being positioned on the inner wall of the mold.

With regard to the dimensions of the members of the basic apparatus, it is recommended that the apparatus is used for casting aluminum or its alloy, and, further, wherein the depth of the feed reservoir ranges from 50 to 200 mm, the dimension of the slit ranges from 0.05 to 0.7 mm, preferably from 0.05 to 0.3 mm, the length of the overhang ranges from 5 to 30 mm, and the vertical distance of each open end of the channels for supplying the lubricating oil ranges from 0.2 to 2.5 mm.

In an embodiment of the basic apparatus, wherein the ascent of gas through the melt is advantageously prevented, the feed reservoir has a downwardly protruding part, which is formed around the innermost annular region at the bottom of the feed reservoir.

According to the object of improving the basic apparatus, there is provided a casting apparatus for direct chilling, the mold is provided therein with channels for supplying a lubricating oil to the inner walls, the channels being uniformly arranged over the inner wall of the mold, and open ends of the channels being positioned on the annular slit region.

In an embodiment of the apparatus for performing the process maintained under an improved supply of the lubricating oil, the radial distance of the open ends from the inner wall of the mold is not more than one half of the radial length of the slit.

According to the object of automatically controlling the direct chill casting of the present invention, there is provided a first control apparatus, which comprises: in addition to the members of the basic and improved apparatuses, mentioned above; at least one thermosensitive element housed in the mold for detecting the temperature of the mold; a control device connected to the thermosensitive element for comparing the detected temperature with a predetermined temperature range of the mold; a means for adjusting the rate of the gas flow introduction into the slit, such adjusting means being connected to the control device; and a means for adjusting the rate of supplying the lubricating agent, such adjusting means being connected to the control device.

According to the object of automatically controlling the direct chill casting of the present invention, there is provided a second control apparatus, which comprises: in addition to the members of the basic and improved apparatuses, mentioned above; at least one thermosensitive element housed in the mold for detecting the temperature of the mold; a means for measuring the gas pressure directly below the overhang; a control device connected to both the thermosensitive element and the pressure measuring means for comparing the detected temperature and pressure with a predetermined temperature and with a pressure range; a means for adjusting the rate of the gas flow introduction into the slit, such adjusting means being connected to the control device; and a means for adjusting the rate of supplying the lubricating agent, such adjusting means being connected to the control device.

The present invention is illustrated in detail with respect to embodiments thereof as well as to the casting experiments performed by the Inventors, in conjunction with the drawings in which.

EMBODIMENT OF BASIC APPARATUS

Figure 1:
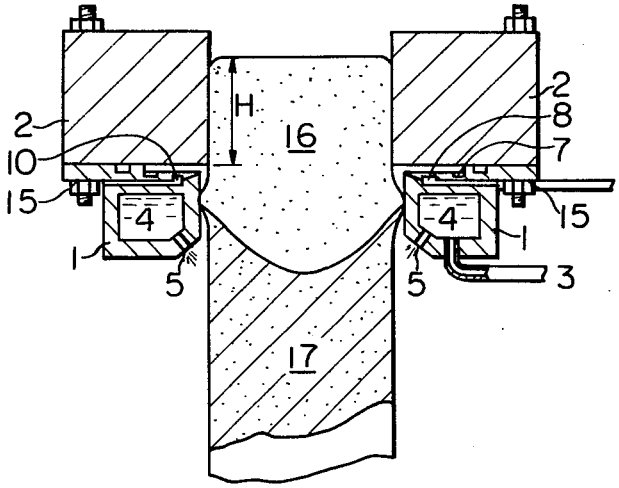
FIG. 1 illustrates, a vertical cross-sectional view of an embodiment of the casting apparatus according to the present invention.

Referring to FIG. 1, the mold 1 made from such material as metal or graphite has a lateral cross-sectional shape suited for defining the configuration of the ingot 17. The mold 1 must therefore have a particular shape for example, a round cross-sectional shape for forming a round ingot 17 and for defining the space in which the ingot 17 is formed. The cooling agent, for example, water 4, for the forced-cooling of the metal in the pillar form flows in the mold 17. A supplying conduit 3 for the water is connected to the mold 1 and supplies the water from a not-shown source into the mold 1. The heat of the metallic melt 16 is absorbed from a part of the inner circumferential surface of the mold 1, whereupon the melt 16 starts to solidify. The solidified part of the metal is illustrated by the diagonal lines in FIG. 1. The metal, which is first cooled by the mold, is thereafter cooled again by the cooling medium sprayed through the outlets 5 toward the ingot 17. The outlets 5 for spraying are formed in the form of either a slit around the entire circumference of the mold 1 or in the form of equidistant apertures which are arranged around the edge of the mold at the lower end thereof. The mediums utilized for the first and second coolings do not necessarily have to be of the same kind; however, both mediums are usually water.

A reservoir 2 for receiving the metallic melt 16 is secured by bolts to the mold 1. The reservoir 2 can be made of a refractory material, such as the well-known materials which have the trade names of Marinite and Fiberflux. The reservoir 2 is co-axially arranged with the mold 1 and has an inner circumferential surface, which extends essentially in parallel to that of the mold 1. The reservoir 2 stores the melt and prevents, even when an amount of melt is varied in the reservoir, variations from occurring in the solidifying level of the molten metal at which level the metal, begins to solidify.

The solidified ingot 17 is continuously withdrawn from the mold 1 by lowering, at a constant rate, i.e. at the casting speed, a not-shown bottom plate which carries the ingot.

Figure 2:
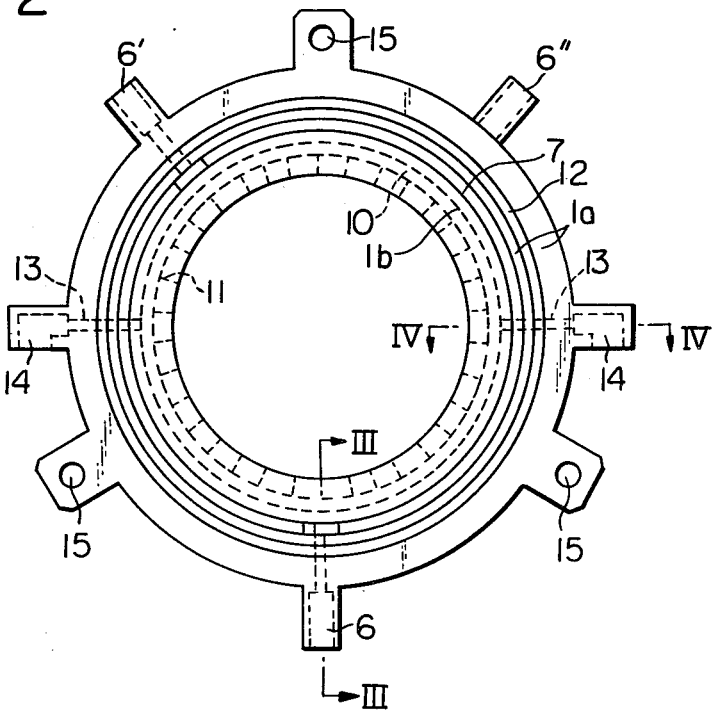
FIG. 2 is a plan view of the apparatus shown in FIG. 1.
Figure 3:
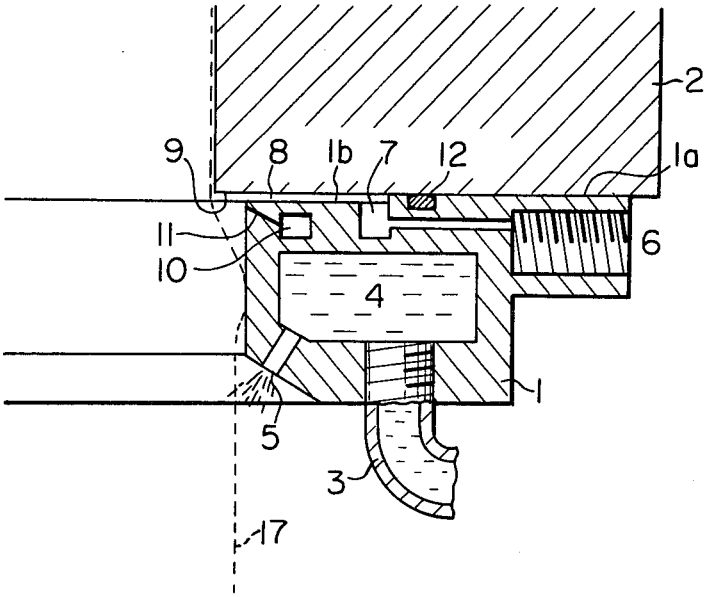
FIG. 3 is a cross-sectional view of the apparatus shown in FIG. 2 along line III—III.
Figure 4:
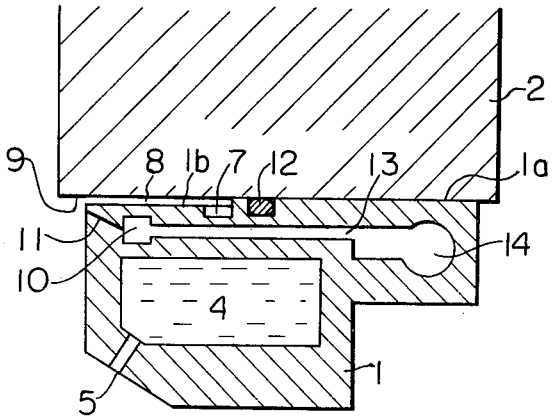
FIG. 4 is a cross-sectional view of the apparatus shown in FIG. 2 along line IV—IV.

Referring to FIGS. 2 through 4, the construction of the casting apparatus is illustrated to clarify the introduction of the gas to a location below the overhang.

Three pieces of conduits 6,6″ and 6‴ (FIG. 2) radially branch off from the outer wall of the mold 1 (FIG. 1), and are spaced with an angle of 120° between every two pieces of the conduits 6,6″ and 6‴ which are communicated with a not-shown air source. An annular channel 7 (FIGS. 2 and 3) extends on the top end of the mold and is communicated with the supplying conduits for air 6,6″ and 6‴. Therefore, the air can be homogeneously distributed over the annular channel 7 and thus over the entire circumferential part of the top of the mold 1. It was proven by the Inventors' experiments that the distribution of the gas in the experiment using two or three supplying conduits 6 is not different from that in the experiments using a single conduit 6.

Because the outer part 1*a* of the top of the mold 1 is a flat surface, this part 1*a* can be brought into very close contact with the bottom surface of the reservoir 2. A groove 12 extending around the entire circumference of the mold is provided on the top part 1*a* of the mold and is used for accommodating the packing made of heat-resistant gum, for preventing the leakage of air from the passage 7.

The inner part 1*b* is lowered slightly from the outer part 1*a* of the mold 1, and, therefore, forms a considerably thin clearance 8 between the inner part 1*b* and the bottom part of the reservoir 2. The clearance 8 communicates with the annular channel 7 at one end of the clearance 8 and is opened at the other end, which end is opened to the entire inner wall of the mold 1. The inner wall of the reservoir 2 protrudes inwardly relative to the inner wall of the mold, so that the bottom surface of the reservoir 2 extends horizontally to cover the space below the protruding bottom surface. Consequently, the overhang 9 is formed around the entire inner wall of the mold 1. The air, therefore, flows successively through the conduits 6,6′, and 6‴, the annular channel 7, and the clearance 8, and is finally introduced into the space directly below the overhang 9.

The mold 1 includes therein a means provided for supplying a liquid lubricating oil between the solidified metal produced by the first cooling and the inner wall of the mold 1. This means comprises a not-shown source of the liquid lubricating agent, not-shown supplying conduits communicated to the source and inlets 14 (FIGS. 2 and 4) of the lubricating oil, to which inlets the conduits are secured. The inlets 14 of the lubricating oil are communicated with the passages 13, which extend diametrically within the mold 1. The passages 13 are communicated in turn with an annular passage 10 for distributing the oil around the hollow space of the mold. A large number of minute channels 11 branch off from the annular passage 10 and are opened to the inner wall of the mold 1. The minute channels 11 for supplying the lubricating oil extend radially toward the interior of the mold and are slanted in a direction opposite to the casting direction. The supplying channels 11 can also extend horizontally or downwardly into the withdrawal direction of the ingot 17. The channels 11 can be extended in any direction in order for the oil to flow through the open end of the channels 11 at the required position of the ingot. According to the construction of the apparatus illustrated above, the liquid lubricating oil can always be introduced directly below the overhang 9 and down toward the inner circumferential surface, i.e. the inner wall, of the mold, because the oil supplied from the inlets 14 exudes from the channels 11.

It will be readily understood by the experts that, since working of the passage 10 and channels 11 in a monolithic mold is almost impossible, it is reasonable to prepare divided parts of the mold in which the passage 10 and channels 11 are already formed and then to bond the parts together by some process such as welding.

EMBODIMENT OF APPARATUS FOR IMPROVED SUPPLY OF LUBRICATING OIL

Figure 12:
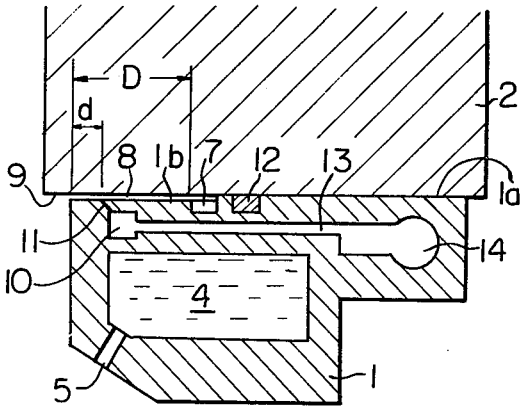
FIG. 12 is a drawing similar to FIG. 4 illustrating channels for lubricating oil, which channels are different from the channels shown in FIG. 4.

Referring to FIG. 12, wherein the same members as those shown in FIG. 4 are designated by the same numbers as used in FIG. 4, the minute channels 11 for supplying a lubricating oil are, according to the feature of the apparatus in FIG. 12, terminated at the inner annular surface 1*b* of the top of mold 1, which surface 1*b* is located opposite the slit 8. The open ends of the channels 11 are located on the top of the mold 1 between the inner extreme portion of the mold and the groove 7 for introducing gas. The distance "d" of the open ends of the channels 11 from the inner extreme portion should preferably be not more than half of the distance "D" between the inner extreme portion and the groove 7 of the mold 1. The more preferable distance "d" is less than 5 mm. When the open ends of the channels 11 for the lubricating oil are located too closely to the groove 7 used for the gas introduction, the lubricating oil can be forced to flow into the groove 7 and to fill at least a part thereof. Consequently, the gas is impeded from being uniformly supplied over the outer circumferential surface of the ingot, thereby making it difficult to obtain a uniform and smooth cast surface. The distance "d" should, therefore, be not more than $\frac{1}{2}$D, preferably less than 5 mm.

The closer the horizontal distance is between every two adjacent open ends of the channels for supplying oil, the more effective is the casting according to the invention. In addition, the greater the number of channels for the lubricating oil is, the more effective is the casting according to the invention. The above two conditions are caused by the lubricating oil being more uniformly distributed around the solidifying metal, and, further, by the uniform supply of oil being not disturbed even when a few of the channels are clogged by dust or the like.

The oil can be more uniformly supplied from every channel, even with a decrease in the diameter of each channel, because the resistance of the passage of oil is increased. Accordingly, the diameter of the channel should preferably be from 0.2 to 3 mm. Since it is difficult to shape each of the channels to one smaller than 0.2 mm in diameter, the possible minimum diameter under this limitation would be 0.2 mm.

The experiments performed by the Inventors for investigating preferable casting conditions will hereinafter be illustrated. Unless otherwise mentioned in the relevant part of the illustration, in these experiments the amount and type of gas as well as the lubricating oil and the dimension of the clearance 8 were varied in accordance with the predetermined casting conditions listed below.

(1) Cast Metal: aluminum designated as 6063 by the AA Standard
(2) Temperature of melt in the basin: 680° C.
(3) Depth of melt in the reservoir: 90 mm
(4) Ingot: round ingot of 6 inches in diameter
(5) Casting speed: 70 mm/minute at the start of casting and 120 mm/minute during when casting was being performed at a steady state
(6) Apparatus: the same apparatus as that shown in FIGS. 1 through 4, except that a single conduit 6 for gas was used. The diameter of each of the channels for supplying the lubricating oil was determined as 0.5 mm, and the total number of channels was determined to be 100. The thickness of the clearance 8 was 0.3 mm, and the length L of the overhang 9 was 10 mm.
(7) Lubricating oil: castor oil
(8) Flowing rate of cooling water: 60 liters/minute
(9) Temperature of cooling water prior to flowing into the mold: 14° C.

CONDITION FOR INTRODUCTION OF GAS

The air introduced into the supplying conduit 6 (FIG. 1) was supplied from the source of compressed air, located in the Applicants' plant, through a needle valve and a floating-type flow meter. The pressure of the air at the source was 5 kg/cm$^2$. A U-shaped manometer having a water head was connected to the other conduit 6' not used for the supply of air. The air stream was adjusted, during the experiments, to a predetermined rate of between 0.2 to 4.0 liters/minute and introduced into a space directly below the overhang 9 as illustrated in detail in FIG. 10. At the same time, the head pressure of the castor oil used as the lubricating agent was adjusted to a pressure 20 mm $H_2O$ higher than the pressure of air.

The following results were obtained from the experiments.

When the rate of air flow was too low, the surface of the produced ingot exhibited a defect known in the art as "exudation", while when the rate of air flow was too high, the surface of the produced ingot exhibited a defect known in the art as a "Zebra-mark" or as a "Pock-mark". It was discovered that the pertinent rate of air flow for providing the excellent cast surface ranged from 0.5 to 3.0 liters/minute. A rate of air flow exceeding the upper limit caused air bubbles to be blown through the melt contained in the basin. The pressure of air, detected by the U-shaped manometer, increased from 195 to 230 mm $H_2O$ proportionally with an increase in the rate of air flow within the above-mentioned range. The optimum rate of air flow for obtaining a very smooth and excellent cast surface was found to be within the range of from 1.0 to 2.0 liters/minute, while the pressure of the air corresponding to the optimum rate of air flow was indicated by the U-shaped manometer as being within the range of from 200 to 214 mm $H_2O$.

The Inventors investigated the relationship between the pressure of air and the hydrostatic pressure of the melt, taking into consideration the publication entitled "METALLURGIE DES ALUMINIUMS", Deutsche Bearbeitung, GEORG SCHICHTEL, 1956, p.20, edited by A. I. Beljaev et al. According to the above publication, aluminum having general purity possesses a density of 2.376 at a temperature of 680° C. The hydrostatic pressure of aluminum at a specified density is calculated to be equal to 214 mm $H_2O$ at a depth of 90 mm of the aluminum melt, which depth being equal to the level of the overhang 9. Accordingly, the optimum air pressure ranges from a pressure of 19 mm $H_2O$ less than the calculated hydrostatic pressure to a pressure of 19 mm $H_2O$ more than the calculated hydrostatic pressure. Although the hydrostatic pressure is not actually measured but calculated, it can be said that the pressure of air applied to the outer circumferential surface of the metal in the pillar or tubular form is in the proximity of the hydrostatic pressure of the metallic melt at the depth corresponding to the level of the overhang. This pressure of the applied air is essentially the same as the pressure of the air introduced into the inlet 6. Since the air pressure is similar to the hydrostatic pressure of the melt at the level directly below the overhang, a space is believed to be formed between the outer surface of the metal and the inner wall of the mold, and the thus formed space elastically expands and shrinks depending on the pressure of the air in the space. Since the maximum pressure of air is below the pressure at which air ascends and floats through the metallic bath, the air in the above-mentioned plastic space cannot escape upwards therefrom. Therefore, an excessive amount of air can only flow downwards from the elastic space. The air escapes through minute channels formed between the inner wall of the mold and a thin solidifying shell of the metallic melt.

The same experiment as explained above was repeated except that air was replaced by a nitrogen gas having a high purity (dew point −70° C.). The effects of the nitrogen gas on the cast surface did not differ from those of the air.

It is therefore concluded that either air or nitrogen can be used as the introducing gas according to the invention. In addition, judging from the physical and chemical effects of every type of gas on aluminum, an inert gas, such as argon gas can obviously be used as the introducing gas.

CONDITION FOR LUBRICATION (PART 1)

The depth of the melt in the reservoir was 100 mm. The rate of air flow was varied from 0.5 to 3.0 liters/minute. The head pressure Ho of the lubricating oil was varied from 250 to 600 mm. The length L of the overhang of the reservoir was 5 mm. In this specification, the head pressure of the lubricating oil is calculated in terms of mm $H_2O$ from the actual head pressure of the oil.

Figure 5:
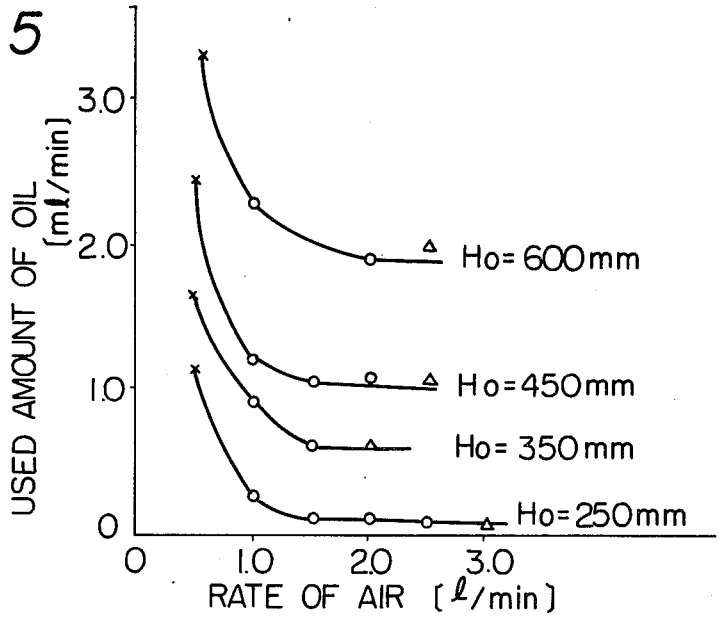
FIG. 5 is a graph showing the actual amount of lubricating oil used (in ml/minute) in relation to the rate of air flow.
Figure 17:
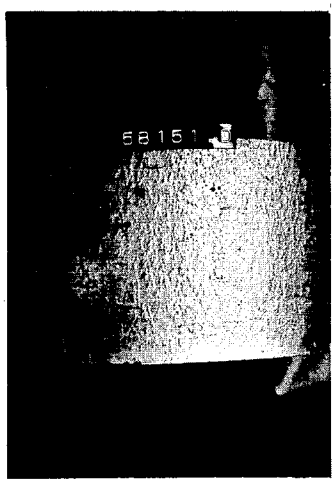
FIGS. 17 through 21 are respective photographs of ingots taken during the experiments, wherein FIGS. 17 through 21 indicate an exudation surface, a "Pock-marked" surface, an excellent smooth surface, a "Zebra-marked" surface and a draw-marked surface, respectively.
Figure 18:
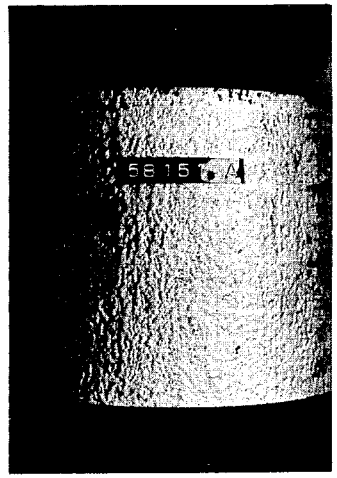

The results of the obtained cast surface are shown in FIG. 5, in which the marks x, O and Δ indicate "an exudation surface (FIG. 17)", an "excellent surface (FIG. 19)" and a "Zebra-marked" surface (FIG. 20)", respectively.

Figure 8:
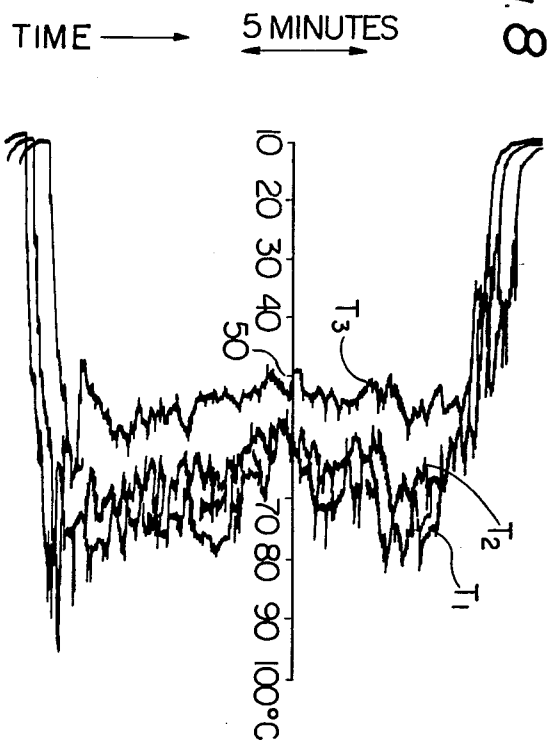
FIG. 8 is a graph, representing temperature variations in the mold, during which variations an exudation surface is formed on the obtained ingot.

The following facts will be clarified from an examination of FIG. 8.

Firstly, when the rate of air flow is pertinently determined, an excellent cast surface can be obtained when the head pressure of the lubricating oil Ho of is from 250 to 600 mm $H_2O$. If the pressure of the lubricating oil is reduced below 250 mm $H_2O$, air would enter into the supplying channels 11 (FIGS. 2 and 3) of the lubricating oil and thus impede the continuous supply of the oil. The minimum head pressure of the lubricating oil for stably supplying the same should be not less than the gas pressure applied directly below the overhang, provided that the rate of introducing the gas is determined within a pertinent range. This minimum head pressure is usually higher than the gas pressure in $H_2O$, by an amount of from 10 to 50 mm $H_2O$.

Secondly, the increased amount of Ho also increases the amount of the lubricating oil actually consumed. However, the increased amount of Ho does not actually exert any influence on the cast surface. It is therefore preferable to reduce the head pressure Ho, from a point of view of economizing the consumption of the oil, as long as the reduced amount of the lubricating oil supply does not cause an interruption in the supply of the lubricating oil.

Thirdly, even a small amount of lubricating oil, such as from 0.2 to 0.5 milliliter/minute is sufficient for providing the improved surface quality of the ingot. This amount of lubricating oil used corresponds to from 33 to 80 milliliters per one ton of aluminum cast at the aforementioned speed.

On the other hand, according to the conventional direct chill casting of aluminum melt in a mold made of an alloy of aluminum or copper, a six-inch billet was cast under the required amount of 100 to 110 milliliters of lubricating oil per ton of aluminum in the case of using the floating distributor. Furthermore, in a case of using the header reservoir for the hot top casting, the amount of the lubricating oil required to be used was reported in the magazine, "Aluminum", 1975, vol. 6, page 339, in the illustration of FIG. 6, to be 1 $cm^3$/minute, when the casting apparatus disclosed in the U.S. Pat. No. 3,381,741 was employed to produce a nine-inch billet of 6063 alloy of AA Standard. Since the usual casting speed in the hot top casting is approximately 120 mm/minute, the amount of the lubricating oil used is assumed to be 133 ml per ton of aluminum alloy.

Consequently, it will be clear from the foregoing description that the amount of the lubricating oil used in the process of the present invention is decreased to an amount which is about one-third to four-fifths of the conventional amount. This decrease in the use of the lubricating oil naturally contributes to economizing the consumption of oil, and in addition, to reducing oil pollution of the cooling water used for the casting process. The process according to the present invention is quite desirable from an environmental point of view, and is also desirable from an economical point of view because the plant and the treatment of the cooling water employed in the present process are low in costs.

Figure 20:
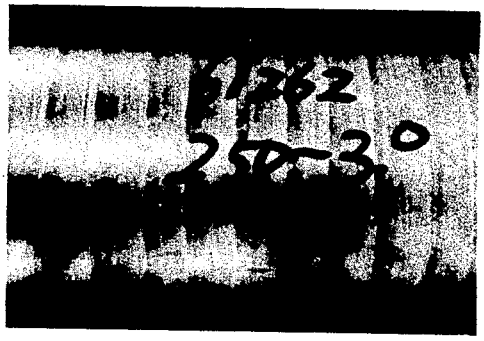

Fourthly, when the rate of air introduction is too high, the Zebra-marked surface as shown in FIG. 20 is formed on the surface of the ingot. The cause for the formation of the Zebra-mark is believed to be the excessive air being present as bubbles floating along the inner wall of the reservoir. The results obtained from this experiment were different from those illustrated in FIG. 5, which difference therebetween is attributable to the difference in the depth $D_M$ of the melt in the reservoir and the length L of the overhang of the reservoir, used, i.e. D=100 mm, L=5 mm in the latter experiment and $D_M$=90 mm, L=10 mm in the former experiment. The maximum rate of air introduction is dependent upon the geometry of the reservoir, particularly the height thereof, because in this experiment by using the reservoir of 100 mm in depth, the rate of air flow could be increased to more than the maximum rate of introduction of air in the previous experiment.

In the previous experiment using the reservoir of $D_M$=90 mm in depth, and L=10 mm in overhang length in addition to an excellent cast surface being provided when the rate of air introduction was 0.5 liter/minute, an excellent cast surface could also be obtained when the rate of air introduction was at least 1 liter/minute of air. Accordingly, "an exudation surface" was obtained and the amount of the lubricating oil used was increased, in accordance with a decrease in the rate of air introduction to a rate less than the given minimum value.

The minimum rate of the air introduction is also dependent on the geometry of the reservoir, particularly on the length of the overhang thereof. Below this minumum rate of air introduction, it is believed that the area where the metal in the pillar form contacts the inner wall of the mold cannot be essentially reduced, with the result being that the first cooling effect by the mold is so great that a defective cast surface is formed.

The preferable rate of air flow for this experiment was 1.5±0.5 liters/minute.

CONDITION FOR LUBRICATION (PART 2)

The same experiment as that of PART 1 was repeated except that in this experiment the head pressure of oil and the rate of air flow were predetermined at about 280 mm and 1.5 liters/minute, respectively. In addition, the kinds of oil utilized in this experiment were as follows: (1) a rape oil, (2) a paste oil (trade name Anthran (Al. No. 17) manufactured by Aiko Rosborrough) and (3) a roller oil (trade name SH-10 manufactured by Palace Chemical). The results obtained by the comparative uses of the lubricating oil were as follows.

(1) Rape Oil

Figure 21:
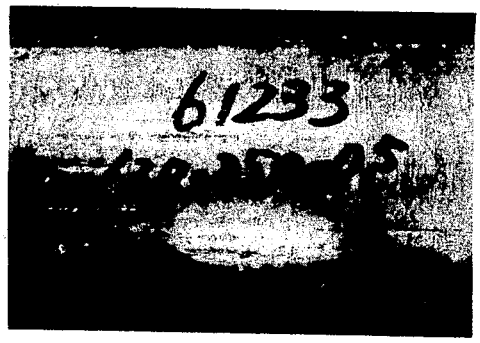

The rape oil supplied under head pressure of 280 mm was forced back by the pressure of air within the mold and caused to flow backwards, so that the skin shown in FIG. 21 was obtained. Since the viscosity of rape oil at 100° F. ranges from 45 to 51 cs and is lower than the viscosity of the castor oil, which ranges from 270 to 300 cs, the rape oil is critically influenced by the variations of the air pressure, and, furthermore, the rape oil is liable to bring about a reverse flow of the oil. It is therefore believed that the rape oil reduces the pertinent range of the rate of air introduction. The amount of consumption of the rape oil was increased to approximately twice the amount of consumption of the castor oil.

(2) Anthran (fine particles of graphite are dispersed in the rape oil by the aid of soap)

The results obtained from the experiment using Anthran were the same as those obtained from using the castor oil.

(3) Roller Oil SH-10 (mineral oil having a viscosity slightly lower than that of the castor oil)

The results obtained from using oil SH-10 were slightly inferior to those obtained by using the castor oil.

From the foregoing results, it can be said that the higher the viscosity of the oil is, the better the casting results are. However, the pertinent viscosity of the lubricating oil for the quality of the cast skin should range from 1 to 60 poises, preferably from 5 to 40 poises, both ranges selected with regard to the cast skin and to the case of the flowing of the oil through the channels.

SUPPLYING POSITION OF LUBRICATING OIL

The experiments for determining the pertinent supplying position of the lubricating oil were performed under the following conditions: the distance between the opening end of the channels 11 (FIG. 3) within the inner wall of the mold and the bottom surface of the overhang 9, i.e., the reservoir 2, was varied by 0.5, 1.5 and 2.5 mm, respectively; the thickness t of the clearance 8 was 0.3 mm.

If the distance t was equal to 2.5 mm, a surface as shown in FIG. 21 would be obtained unless the rate of air introduction was considerably increased. With a decrease in the distance, the critical rate of air introduction, at which rate the draw mark starts to be formed on the ingot, was also decreased. This decrease is believed to be the results of the contact position of the metallic body with the inner wall of the mold being moved upwards and downwards depending upon the rate of air introduction. Consequently, the lubricating agent must be supplied to the higher position when the contact position is moved to a higher level due to the decrease in the rate of air introduction. It is therefore important in the basic process of the present invention that the location of the opening end of the lubricating oil be positioned lower than the clearance for introducing the gas. If this location is not satisfactorily positioned, i.e., the above-mentioned opening end and the oil-channels are positioned to the same level or the latter are positioned above the former, a smooth introduction of air into the space directly below the overhang will be impeded.

GEOMETRY OF FEED RESERVOIR

Figure 6:
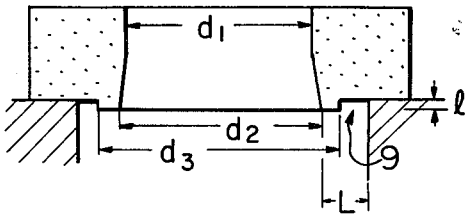
FIG. 6 illustrates a vertical cross-sectional view of an embodiment of the feed reservoir.
Figure 19:
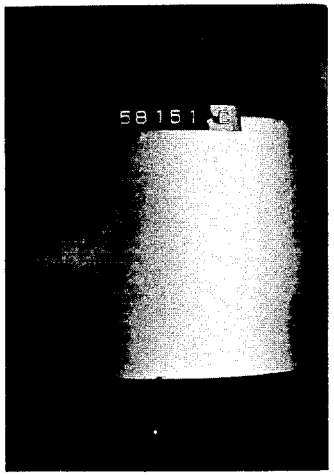

The casting experiment was performed using the feed reservoir as shown in FIG. 6. The overhang 9 of the reservoir in FIG. 6 includes the part protruding downwardly and positioned around the most inner circumferential part of the overhang 9. The outlet part of the inner reservoir wall is broadened in the casting direction. Twenty-four dimensions of the reservoir were tested by combining the values of the upper inner diameter $d_1$, the lower inner diameterd $d_2$, the outer diameter of the above-mentioned protruding part $d_3$ and the length of this part l: $d_1=120$ or 130 mm; $d_2=130$ or 140 mm; $d_3=140$, 150 or 155 mm; and $l=1$ or 4 mm. The excellent, smooth cast surface as shown in FIG. 19 could be formed on the produced ingot from any combination of the dimensions $d_1$, $d_2$, $d_3$ and l, when the pressure or rate of the air flow and the aforementioned conditions were appropriately selected.

For comparison purposes, a feed reservoir without the protruding part, i.e. $l=0$, was used. It was proven as a result of such a comparison that the range of the optimum air-flowing rate was broaden in the case of using the feed reservoir with the protruding part rather than in the case of using the feed reservoir without the protruding part. The reason for this result was because the gas was impeded to flow upwards into the feed reservoir by the existence of the protruding part of the overhang.

EFFECTS OF INTRODUCED AIR

Figure 7:
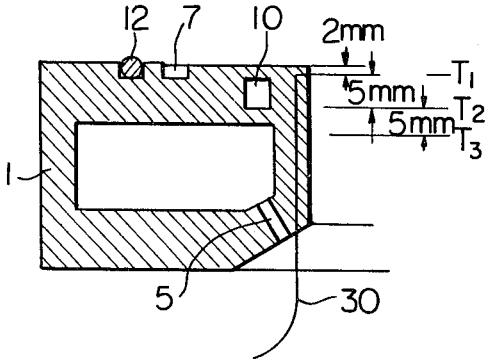
FIG. 7 illustrates a part of the mold into which thermocouples are inserted.

In order to investigate the effects of the air which is introduced directly below the overhang, experiments were performed using the mold shown in FIG. 7 which includes three inserted thermocouples, one of which is shown in FIG. 7 as numeral 30. The front end of the three thermocouples was removed from the top surface of the mold at distances of 2, 7, and 12 mm, respectively. The temperatures measured at distances of 2, 7 and 12 mm were hereinafter indicated as $T_1$, $T_2$ and $T_3$, respectively. The temperature variations occurring from the beginning to the end of the casting were measured. The curves of the temperature variations in FIG. 8 correspond to those, in which the exudation surface was obtained, and the curves of the temperature variations in FIG. 9 correspond to those in which the excellent surface was obtained. The following facts will be apparent from a comparison of both figures.

Firstly, both figures show that at the start of casting, the temperatures $T_1$, $T_2$ and $T_3$ increase exceedingly, then decrease somewhat and, subsequently, vary within relatively narrow ranges and are maintained at almost constant levels.

Figure 9:
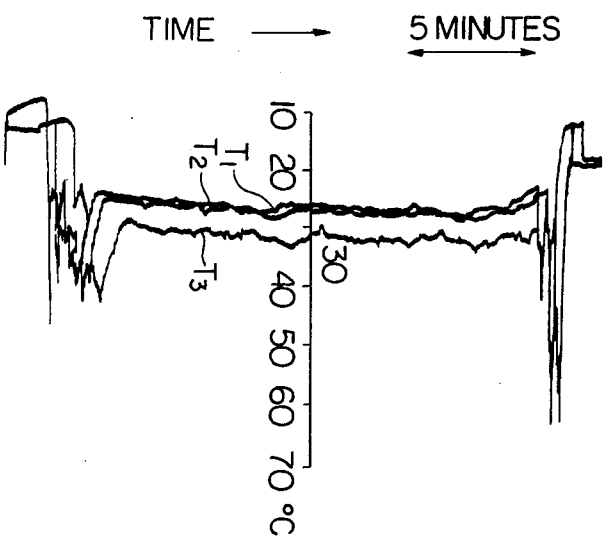
FIG. 9 is graph similar to FIG. 8 representing temperature variations in the mold during which variations the excellent smooth surface is obtained.

Secondly, the temperature variation shown in FIG. 8 is quite different from the temperature variation shown in FIG. 9 when both temperature variations are compared together in detail. Namely, (a) in FIG. 8 showing the obtained exudation surface, the constant levels of temperatures $T_1$, $T_2$ and $T_3$ are higher than those in FIG. 9 showing the obtained excellent surface, due to the reasons given hereinbefore, i.e. the low rate of air flow directly below the overhang; (b) the variations of these constant levels in FIG. 8 are larger than those in FIG. 9; (c) temperatures $T_1$ and $T_2$ are higher than the temperature $T_3$ in FIG. 8, while in FIG. 9, the temperature $T_3$ is higher than the temperatures $T_1$ and $T_2$; and (d) the temperatures $T_1$, $T_2$ and $T_3$ increase exceedingly and decrease immediately when casting is terminated as shown in FIG. 9.

The facts (a) through (d), above, and the presently known mechanism of the conventional direct chill casting teach that the introduced air behaves as follows. When the exudation surface is formed on the aluminum ingot, the aluminum is considered to be subjected to the drastic first cooling over the entire area of the aluminum, corresponding to the measured points $T_1$, $T_2$ and $T_3$, at which points the aluminum is brought into contact with the mold. Such drastic first cooling is observed in the conventional direct chill casting. On the other hand, the cooling mechanism in the present invention is believed to be completely different from the conventional one, although the mechanism in the present invention is still not completely elucidated.

Figure 10:
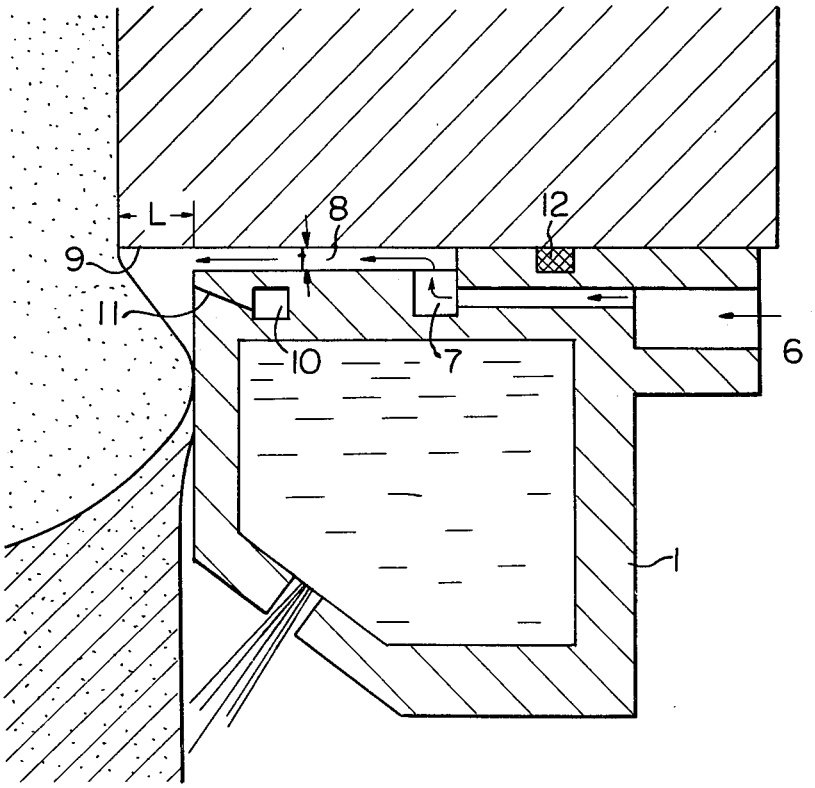
FIG. 10 is an enlarged, schematic view of the part of the apparatus shown in FIG. 1 for the purpose of illustrating the casting mechanism.

Referring to FIG. 10, the melt is forced out from the region directly below the overhang 9, by the effects of the air introduced along the flowing line shown by the five arrows in the figure. The melt is brought into contact with the mold 1, at a position of the mold, which position is considerably lowered below the top end of the mold. When this contact is initiated, a thin solidified shell is immediately formed and gradually separated from the mold. The length of the melt, which is in contact with the inner wall of the mold, is considerably reduced in the casting direction with the result of decreasing the first cooling effect. The casting procedure, as schematically illustrated in FIG. 10, is considered to be the predominant reason for producing the advantageous effects of the present invention.

The other reason for producing an advantageous effect is possibly attributed to a decrease in the influence of the variation in the level of the metallic melt in the feed reservoir and to a decrease in the influence of the disturbance in the flowing method of the melt in the feed reservoir upon the solidification process of the melt due to gas being present directly below the overhang. As a result of such decreases, the variation in the level of the metallic melt and the disturbance in the poured stream of melt cannot directly affect the solidifying melt, and the solidification thereby proceeds under constant conditions regardless of the presence of the above-mentioned variation and disturbance.

OTHER CASTING CONDITIONS

Taking into consideration all the experimental results and the cooling mechanism described above, the dimension "t" of the clearance 8 (FIG. 10) must be such that no melt can be allowed to penetrate therein no matter how low the air pressure is. The dimension "t" is therefore dependent upon the surface tension and upon the hydrostatic pressure of the melt. Since the usual height of the feed reservoir is in a range of from 50 to 200 mm, preferably from 50 to 150 mm the dimension "t" should be from 0.05 to 0.7 mm at the maximum, and more preferably from 0.3 to 0.7 mm at the maximum.

In addition, the length "L" of the overhang 9 (FIG. 10) should be such that the longitudinal length of the contact between the melt and the inner wall of the mold should be as short as possible. The length "L" is, therefore, dependent upon the predetermined rate of air flow and the surface tension of the melt. The length "L" should usually be from 5 to 50 mm, more preferably from 10 to 30 mm.

The protruding length l (FIG. 6) of the overhang 9 in the withdrawal direction of the ingot should usually be from 0 to 5 mm, more preferably from 1 to 2 mm.

The height of the mold should usually be from 20 to 70 mm, more preferably from 25 to 45 mm.

The casting speed in the present invention can be the same as that in the conventional process. It is however to be noted that the optimum rate of air flow varies depending on the casting speed. Generally, the higher the casting speed is, the lower the optimum rate of air flow.

INVERSE SEGREGATION OF ALLOYING ELEMENTS IN INGOT

As is explained previously, the quality of ingot formed by the continuous casting is evaluated not only by examining the cast surface, but also by examining the degree of the inverse segregation of the alloying elements in the ingot. The inverse segregation in the process of the present invention is explained below.

Seven-inch billets were produced with regard to aluminum alloys of 7075, 2024, and 2014 of AA Standard, respectively, by using both the method according to the invention and the conventional continuous casting method using a floating distributor. The casting speed was 100 mm/minute with regard to both methods. The conditions employed in the method of the present invention were: the height of the feed reservoir for the melt being 100 mm; the rate of introducing nitrogen directly below the overhang being 1.0 liter/minute, this flowing rate corresponding to a pressure of 245 mm $H_2O$; using castor oil as the lubricating agent at a head pressure of 260 mm; and the amount of oil used being 0.3 liter/minute.

Figure 11:
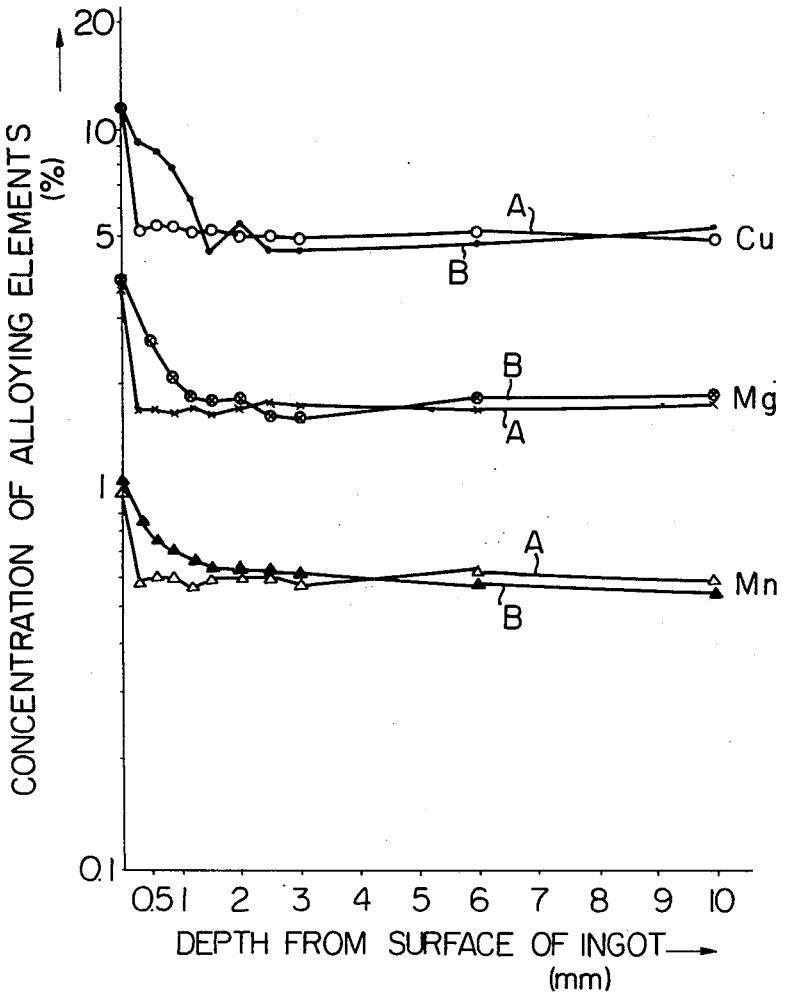
FIG. 11 is a graph representing the distribution of the concentrations of the alloying elements in the AA2024 alloy.

Referring to FIG. 11, the lines A and B indicate the distribution of the alloying elements obtained by the method of the present invention and the conventional method, respectively. As shown by both lines, the concentration of the alloying elements decreases from the maximum, segregated concentration on the surface of the billet to the constant concentration, with an increase in the distance from the surface. This distance, at which the concentration of the alloying element is decreased to the constant level, is summarized in Table I, below.

Table I

| Alloy | Component | Invention | Conventional process |
|---|---|---|---|
| 7075 | Zn | Not more than 0.3mm | 1.8 mm |
| | Mg | " | 1.6 mm |
| | Cu | " | 2.0 mm |
| | Cr | " | 0.7 mm |
| 2024 | Cu | " | 2.2 mm |
| | Mg | " | 1.6 mm |
| | Mn | " | 2.0 mm |
| 2014 | Cu | " | 2.0 mm |
| | Si | " | 1.2 mm |
| | Mn | " | 21 mm |
| | Mg | " | 1.4 mm |

As is clear from this Table, the inverse segregation layer is about 1 to 2 mm from the surface in the conventional method but is reduced to not more than 0.3 mm deep from the surface in the present invention. That is, at the concentration measuring point closest to the billet surface, i.e. 0.3 mm, segregation could no longer be detected. The segregation layer in the present invention is, therefore, very thin and equal to from one-third to one-sixth of that in the conventional method.

It is to be noted that the surface segregation in the present invention is equivalent to a reduced surface segregation such as that achieved by using the electromagnetic method, which reduced surface segregation was reported on page 215 of the Japanese journal, "Light Metals", Vol. 26, No. 4 (April, 1976), to be not more than 0.3 mm with regard to the alloying component of Cu.

CONTROL APPARATUS

Figure 13:
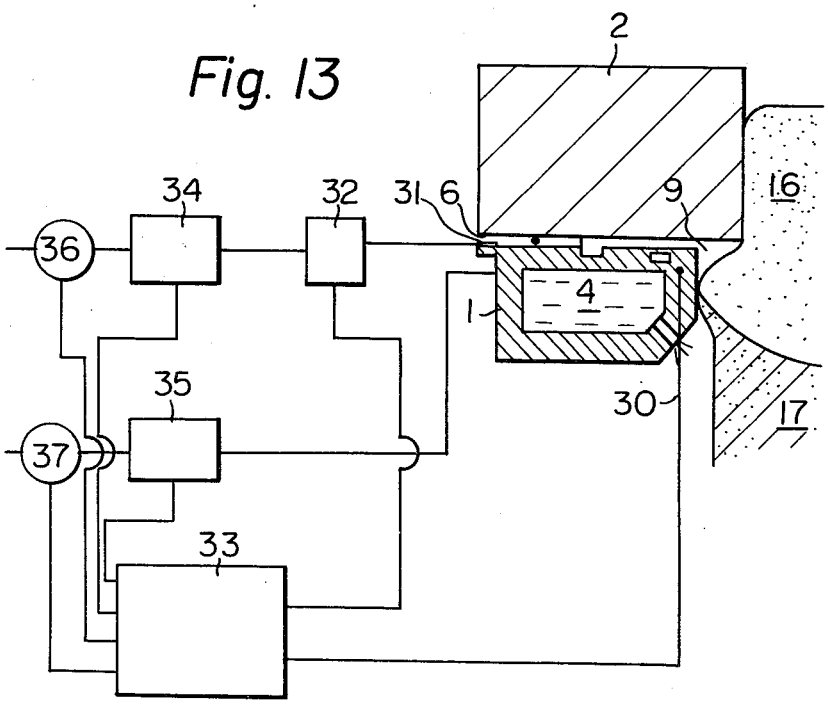
FIG. 13 is a block diagram of an embodiment of a control apparatus according to the invention for controlling the casting parameters when the melt is cast in the mold.

Referring to FIG. 13, a thermosensitive element 30, such as a thermocouple and the like, is housed in the forced-cooling mold 1. In the case of a melt of aluminum or its alloy, the thermocouple 30 used can be a copper-constantan wire having a diameter of 1 mm and enclosed in a sheath. The single thermocouple 30 located in the mold can be used to determine the temperature of the mold over the entire circumference of the mold's inner wall. A plurality of the thermocouples 30 may be arranged equidistantly along the circumference, so that the average temperature of all the temperatures measured by the thermocouples can be used to represent the temperature of the mold.

A device 31 for measuring pressure is fixed to the mold 1 and is communicated with the annular space, which space surrounds the metal 16 directly below the overhang 9, for detecting the gas pressure directly below the overhang 9. The pressure measurement device 31 is connected to a device 32 for converting the measured pressure P to an electrical signal.

A control device 33, which is connected to both the pressure converting device 32 and the thermosensitive element 30, records the predetermined gas pressure and the temperature of the inner wall of the mold, compares the measured gas pressure and temperature of the inner wall with the predetermined respective values, and then determines whether or not the compared difference between the measured values and the predetermined values falls within a predetermined range. The control device 33 can perform differentiation of the values detected by the devices 30 and 32 based on time, and decide whether or not these differential values fall within a predetermined range.

An electromagnetic valve 36 for cutting off the flow of gas is connected to the converting device 34 for converting pressure into electrical signals. This electromagnetic valve 36 for shutting off the gas flow is connected to the control device 33 when the above-mentioned differential in the control device 33 indicates that the temperature of the mold has decreased to a temperature lower than the predetermined temperature.

An electromagnetic valve 37 for cutting off the flow of the lubricating oil is connected to a regulation device 35 for regulating this flow, so that such valve 37 can be used to shut the flow of oil to the regulation device 35.

The output signal of the control device 33 is transmitted to a valve 34 for controlling the gas flowing rate, thereby controlling the rate of gas, which gas flows through the three conduits 6 (FIG. 2). The output signal of the control device 33 is also transmitted to the regulation device 35 for controlling the rate of flow of the lubricating agent, thereby controlling the rate of oil, which oil flows through inlets 14 (shown in FIG. 2 but not in FIG. 13). The output signal of the device 33 is also transmitted to the valves 36 and 37 for shutting off these valves when abnormal signals are detected by the device 33. The shutting off of these valve 36 and 37 automatically actuates the process for stopping the lowering of the bottom plate and for stopping the pouring of metal into the mold 1. The control device 35 can be a commercially available device for supplying oil at variable rates and of constant rates.

Figure 14:
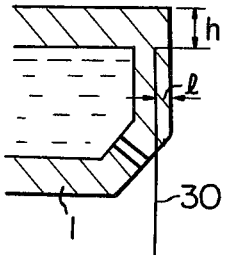
FIG. 14 is a partially cross-sectional view showing the inserting position of the thermocouples.

Referring to FIG. 14, the top end of each thermocouple 30 is separated from the top of the mold 1 by a distance denoted as "h". The distance "h" should be such that the top end of each thermocouple 30 is positioned above the lower extremity of the annular space described in the following sentences. The annular space is formed by the pressure applied to the outer circumference of the melt 16 (FIG. 1) and surrounds the melt 16. The lower extremity of this annular space is, therefore, a position of the cast metal at which the metal comes into contact with the inner wall of the mold. The distance "h" is from 1 to 10 mm, preferably 2 mm, when the melt is aluminum or its alloy. The horizontal distance "l" between the thermocouples and the inner wall of the mold may be from 1 to 5 mm, preferably 1.5 mm. The distance "l" is, however, measured not from the central axis of each thermocouple, but from the inner wall of each insertion hole for the thermocouples to the inner wall of the mold.

EFFECTS OF BASIC PROCESS AND APPARATUS

A. The defective cast surface, which is one of the disadvantageous results of the conventional, hot-top, direct chill casting process, is improved by using the present basic process. The smooth surface and stable quality of the cast surface produced by the basic process is completely different from the quality of cast surfaces produced by the conventional process.

B. The casting operation is caused to become stable in the basic process by employing a simple means, i.e. controlling the rate of flowing gas and, if necessary, detecting the applied gas pressure.

C. The amount of lubricating oil consumed or used is considerably lower than that used in the conventional process, so that pollution in the drainage system of the cooling water used for the mold can be reduced.

D. The degree of roundness of the round ingot is far superior to that of ingots obtained by the electrodynamic casting, such electrodynamic casting being performed under a noncontacting state between the metal body and the mold, thus inevitably producing an ingot with a poorer degree of roundness.

E. Inverse segregation of the alloying elements is decreased.

F. It may be possible to work the ingots produced by the basic process and exhibiting a decreased inverse segregation by employing indirect extrusion. On the contrary, such indirect extrusion which requires a shallow layer of segregation cannot be applied to ingots produced by the conventional method.

EFFECTS OF IMPROVED LUBRICATING PROCESS

A. Melt of such alloys as 2011 alloy of AA Standard, which exhibits a low surface tension, is forced into the lubricating oil-supplying channels, terminating at the inner wall of the mold. A drawn mark or cracked surface can be formed on the ingot, when casting is performed by using the basic process or apparatus. However, according to the improved lubricating process, a defective cast surface is not produced when such alloys as 2011 are cast. It was proven that the oil-supplying channels, which terminate at the top of the mold, do not impede the uniform passage of gas through the slit. It was also proven that the lubricating oil does not flow backwardly into the groove of the introduced gas.

B. The oil-supplying channels are not clogged by the polishing of the inner wall of the mold.

C. The distribution of the lubricating oil is uniform. The reason for the uniform distribution is supposed to be that streams of oil would spread while the oil flows from the supplying channels to the metal body. The working precision of the supplying channels is less precise compared to that of the basic process, in which basic process these channels terminate at the inner wall of the mold.

D. It is possible to polish the inner wall of the mold without causing a danger of clogging the channel when the inner wall of the mold becomes damaged.

EFFECTS OF AUTOMATICALLY CONTROLLED PROCESS

A. It is possible to stably produce, on an industrial scale, an ingot having a smooth cast surface with reduced segregation.

B. It is possible to enhance the reliability of the casting operation and to economically reduce the labor force required, by automatically controlling the casting parameters.

C. The multi strand casting is realized by the control process, because without the automatic control it is practically impossible to individually control the casting parameters of each of the molds in such a controlled manner that the casting parameters are determined for the metal in each of the molds.

The present invention will hereinafter be described in detail by way of Examples.

EXAMPLE 1

Casting was performed under the following conditions.

A. Cast Alloy

Table II

| Designation | Components | | | | | | |
|---|---|---|---|---|---|---|---|
| | Cu | Mg | Si | Cr | Fe | Ti | Al |
| 6061 | 0.25 | 1.0 | 0.6 | 0.25 | (0.20) | (0.01) | bal |
| 6063 | (0.02) | 0.52 | 0.42 | (0.001) | (0.20) | (0.01) | bal |

B. Temperature of Melt in Feed Reservoir: 680° C.
C. Depth of Melt in Feed Reservoir: 90 mm
D. Ingot: a round ingot of 6 inches in diameter
E. Casting Speed: 120 mm/minute
F. Casting Apparatus: FIGS. 1, 2, 3 and 4
Dimension of slit: 0.15 mm
Length of overhang: 10 mm
G. Lubricating Oil: Castor oil
H. Rate of Supplying Cooling Water: 60 l/minute
I. Temperature of Cooling Water: 14° C.
J. Pressure Applied to Lubricating Oil: 250 mm oil-head
K. Rate of Lubricating Oil Flow: 0.2 ml/minute
L. Rate of Air Flow: 1.0 l/minute An ingot exhibiting an excellent cast surface was produced.

EXAMPLE 2

Casting was performed under the following conditions.

A. Cast Alloy

Table III

| Designation | Components | | | | | |
|---|---|---|---|---|---|---|
| | Cu | Mg | Si | Fe | Ti | Al |
| 6063 | (0.005) | 0.55 | 0.43 | (0.22) | (0.015) | bal |

B. Temperature of Melt in Feed Reservoir: 680° C.
C. Depth of Melt in Feed Reservoir: 100 mm
D. Ingot: a round ingot of 12 inches in diameter
E. Casting Speed: 110 mm/minute
F. Casting Apparatus: FIGS. 1, 2, 3 and 4
Dimension of slit: 0.15 mm,
Length of overhang: 30 mm
G. Lubricating Oil: Castor oil
H. Rate of Supplying Cooling Water: 150 l/minute
I. Temperature of Cooling Water: 14° C.
J. Pressure Applied to Lubricating Oil: 500 mm oil-head
K. Rate of Lubricating Oil Flow: 0.8 ml/minute
L. Rate of Air Flow: 3 l/minute An ingot exhibiting an excellent cast surface was produced.

EXAMPLE 3

Casting was performed under the following conditions.

A. Cast Alloy

Table IV

| Designation | Components | | | | | | | | |
|---|---|---|---|---|---|---|---|---|---|
| | Si | Fe | Cu | Mn | Mg | Cr | Zn | Ti | Al |
| 7079 | (0.08) | (0.25) | 0.6 | 0.2 | 3.3 | 0.20 | 4.3 | (0.02) | bal |

B. Temperature of Melt in Feed Reservoir: 690° C.
C. Depth of Melt in Feed Reservoir: 100 mm
D. Ingot: a round ingot of 12 inches in diameter
E. Casting Speed: 90 mm/minute
F. Casting Apparatus: FIGS. 1, 2, 3, and 4
Dimension of slit: 0.15 mm
Length of overhang: 30 mm
G. Lubricating Oil: Castor oil
H. Rate of Supplying Cooling Water: 160 l/minute
I. Temperature of Cooling Water: 14° C.
J. Pressure Applied to Lubricating Oil: 500 mm oil-head
K. Rate of Lubricating Oil Flow: 0.8 ml/minute
L. Rate of Air Flow: 3 l/minute An ingot exhibiting an excellent cast surface was produced.

EXAMPLE 4

Casting was performed under the following conditions.

A. Cast Alloy

Table V

| Designation | Components | | | | | | | | |
|---|---|---|---|---|---|---|---|---|---|
| | Si | Fe | Cu | Mn | Mg | Cr | Zn | Ti | Al |
| 7075 | (0.10) | (0.20) | 1.6 | (0.005) | 2.5 | 0.27 | 5.6 | (0.02) | bal |
| 2024 | (0.08) | (0.18) | 4.4 | 0.6 | 1.6 | (0.006) | (0.002) | (0.02) | bal |
| 2014 | 0.8 | (0.22) | 4.5 | 0.8 | 0.6 | (0.004) | (0.005) | (0.02) | bal |

B. Temperature of Melt in Feed Reservoir: 690° C.
C. Depth of Melt in Feed Reservoir: 90 mm
D. Ingot: a round ingot of 7 inches in diameter
E. Casting Speed: 100 mm/minute
F. Casting Apparatus: FIGS. 1, 2, 3 and 4
Dimension of slit: 0.15 mm
Length of overhang: 10 mm
G. Lubricating Oil: Castor oil
H. Rate of Supplying Cooling Water: 60 l/minute
I. Temperature of Cooling Water: 20° C.
J. Pressure Applied to Lubricating Oil: 260 mm oil-head
K. Rate of Lubricating Oil Flow: 0.3 ml/minute
L. Rate of Air Flow: 1.5 l/minute An ingot having an excellent cast surface was produced.

EXAMPLE 5

Casting was performed under the following conditions and under the conditions mentioned particularly in Table VI below.

A. Cast Alloy

Table VI

| Designation | Components | | | | | | |
|---|---|---|---|---|---|---|---|
| | Cu | Mg | Si | Pb | Bi | Ti | Al |
| 2011 | 5.4 | (0.01) | (0.08) | 0.45 | 0.45 | (0.02) | bal |
| 6063 | (0.005) | 0.54 | 0.42 | Trace | Trace | (0.01) | bal |

B. Temperature of Melt in Feed Reservoir: 670° C.
C. Depth of Melt in Feed Reservoir: 95 mm
D. Ingot: a round ingot of 7 inches in diameter
E. Casting Speed: 120 mm/minute
F. Casting Apparature: FIG. 12
Dimension of slit: 0.15 mm
Length of overhang: 10 mm
G. Lubricating Oil: Castor oil
H. Rate of Supplying Cooling Water: 80 l/minute
I. Temperature of Cooling Water: 14° C.
J. Pressure Applied to Lubricating Oil: 100 mm oil-head.
K. Rate of Lubricating Oil Flow: 0.2 ml/minute
L. Rate of Air Flow: 2.5 l/minute The distance "d" in FIG. 12 was varied as given in Table VII, in which casting results are also described.

Table VII

| Alloy | Distance(d) | Results |
|---|---|---|
| 2011 | 0 mm (invention) | The metal penetration took place when the diameter of the oil channels was greater than 0.3 mm. However, no metal penetration took place when the diameter of the oil channels was less than 0.3 mm. |
| | 0.5 mm (invention) | The cast surface was uniform and smooth over the entire surface of the ingot. |
| | 3 mm (invention) | " |
| | 5 mm (invention) | The draw mark was formed to a slight extent at a limited part of the ingot but disappeared when the rate of oil supply was increased to 1 ml/minute. |
| | 1/2D(12 mm) (control) | The draw mark was formed over one-eighth of the circumferential surface of the ingot, and did not disappear when the rate of oil supply was increased. A smooth and uniform cast skin could not be obtained. |
| | 2/3D(16 mm) (control) | The draw mark was formed over one-fourth of the circumferential surface of the ingot, and did not disappear when the rate of oil supply was increased. A smooth and uniform cast skin could not be obtained. |
| 6063 | 0 mm (control) | The metal penetration took place when the diameter of the oil channels was greater than 0.7 mm, but disappeared when the diameter was decreased. |
| | 0.5 mm (invention) | The cast surface was uniform and smooth over the entire surface of the ingot. |
| | 1/2D(12 mm) (invention) | The same results as those in alloy 2011, wherein distance(d) equals 1/2D. |
| | 2/3D (16 mm) (invention) | The same results as those in alloy 2011, wherein distance(d) equals 2/3D. |

EXAMPLE 6

Casting was performed under the following conditions.

A. Cast Alloy: A5056
B. Temperature of Melt in Feed Reservoir:
C. Depth of Melt in Feed Reservoir: 90 mm
D. Ingot: a round ingot of 8 inches in diameter
E. Casting Speed: 100 mm/minute
F. Casting Apparatus: FIGS. 1 through 4 and FIG. 13
Dimension of slit: 0.15 mm
Length of overhang: 10 mm
G. Lubricating Oil: Castor oil
H. Rate of Supplying Cooling Water: 80 l/minute
I. Temperature of Cooling Water: 20° C.
J. Pressure Applied to Lubricating Oil: 400 mm oil-head After 15 minutes had lapsed from the start of casting and steady casting states had been achieved, the control of casting was performed as follows.

Figure 15:
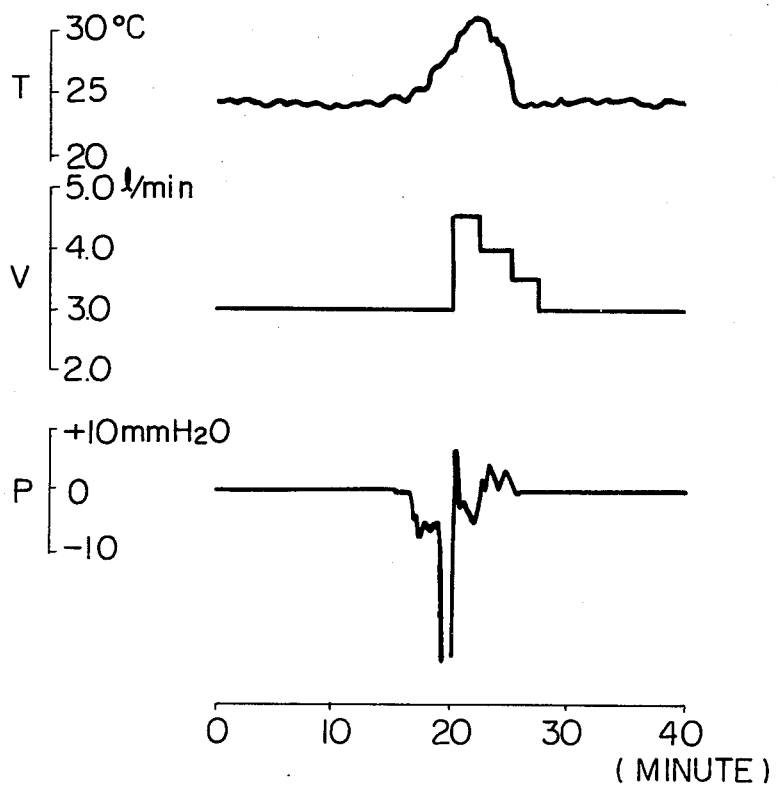
FIG. 15 show graphs respectively illustrating the variations of T, V and P during a period of steady casting.

Referring to FIG. 15, the steady casting states were continued over a period of approximately 18 minutes, wherein the temperature (T) of the inner wall of the mold was maintained at 25° C., and, further, the pressure (P) directly below the overhang was maintained at ±0 mm $H_2O$. During the steady state, the gas introduction rate was adjusted at a constant value of 3.0 l/minute.

Subsequently, the rate of air flow (V) was abruptly increased from 3.0 to 4.5 l/minute in an amount corresponding to approximately 150% of the previous rate, when an increase in the temperature (T) from 25 to 28° C., i.e. an increase of more than 10% of the previous temperature, was detected. The rate of air flow (V) was then maintained at 4.5 l/minute over a period of 150 seconds, and, subsequently, the increase in the temperature (T) was reduced to zero. When the temperature (T) started to decrease, the rate of air flow was successively reduced from 4.0 to 3.5, then to 3.0 liters/minute. The temperature (T) could be returned to the predetermined value of (To) 25° C., by controlling the rate V as illustrated above, thus decreasing the temperature T which was previously increased.

The pressure P behaved as follows. The pressure P exhibited a variance in accordance with an increase in the temperature T. During this variance, the pressure P was rapidly decreased to almost atmospheric pressure. Prior to the reversion of temperature T to the predetermined temperature To of 25° C., the pressure P was reverted to Po=0 and stabilized.

Accordingly, in order to revert the pressure P, which exhibits such variance as disturbing a steady state of the pressure P, to the pressure before this variance, the following approaches are suggested: (1) to preferably carry out the detection of the variation of P rather than the detection of the variation of T, since the variation of P is more distinct than that of T, in order to rapidly determine the occurrence of abnormal incidents mentioned hereinbefore; (2) of the controllable parameters V and Q, to control only the parameter V for reverting V to Vo; and (3) to revert the parameter V in stepwise manner to the predetermined value, when the differentiated value T is reduced to zero.

EXAMPLE 7

Casting was performed under the following conditions.

A. Cast Alloy: AA6063
B. Temperature of Melt in Feed Reservoir: 680° C.
C. Depth of Melt in Feed Reservoir: 90 mm
D. Ingot: a round ingot of 6 inches in diameter
E. Casting Speed: 150 mm/minute
F. Casting Apparatus: FIGS. 1 through 4 and FIG. 13
Dimension of slit: 0.15 mm
Length of overhang: 10 mm
G. Lubricating Oil: Castor oil
H. Rate of Supplying Cooling Water: 60 l/minute
I. Temperature of Cooling Water: 20° C.
J. Pressure Applied to Lubricating Oil: 500 mm oil-head The control of casting directly after its start was performed as follows.

Figure 16:
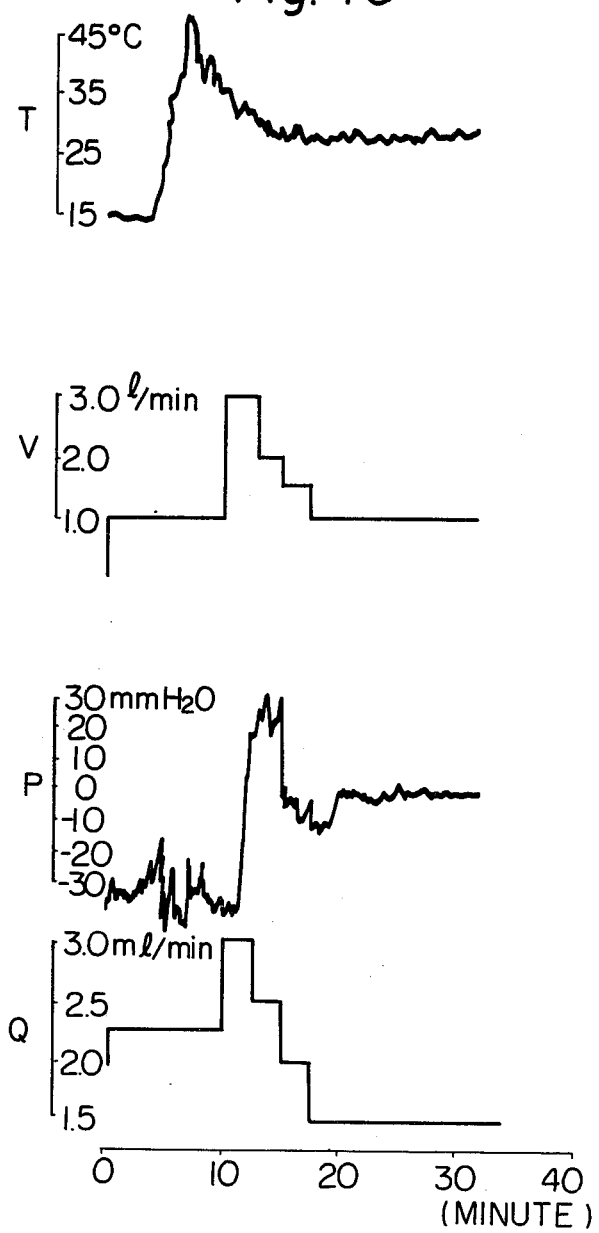
FIG. 16 show graphs respectively illustrating the variations of T, V, P and Q at the initial period of casting.

Referring to FIG. 16, rate of the air introduction was 1.0 l/minute for the first ten minutes. The temperature (T) was increased from room temperature to a peak temperature of 45° C., and then decreased. While the (V) value was 1.0 l/minute, the rate Q of the lubricating oil flow was maintained at an initial constant value of 2.25 ml/minute. During the initial period, wherein the values (T) and (Q) were 1.0 and 2.25, respectively, the pressure "P" was found to vary around an average value of −30 mm $H_2O$.

In order to increase the pressure "P", the parameters V and Q were adjusted to the abruptly increased values of 3.0 l/minute and 3.0 ml/minute, respectively. As a result of this, the pressure (P) was steeply increased, while the temperature (T) maintained a tendency for decreasing as before. Since the pressure (P) considerably exceeded Po=0 mm $H_2O$, both the parameters V and Q were decreased stepwise to 1.0 l/minute and 1.5 ml/minute, respectively. During this decreasing period, the pressure (P) was decreased from approximately 30 mm $H_2O$ to a level which slightly varied around 0 mm $H_2O$. Namely, the pressure "P" was stabilized around the Po=0 mm $H_2O$.

Accordingly, in order to rapidly move the pressure (P) to the predetermined value Po at the start of casting, the following approaches are suggested: (1) since the temperature (T) is suddenly increased by the heat of the melt, which is supplied at the start of casting, and, further, since the temperature (T) gradually approaches around the predetermined value, it is not necessary to detect the temperature T for monitoring the casting conditions. This is because the pressure P is not yet stable regardless of the stabilizing of the temperature T; (2) both V and Q are simultaneously abruptly increased; and (3) since the increase of P from −30 to +30 mm $H_2O$ and the decrease of P from +30 to 0 both take place abruptly and within a short period of time, the values V and Q are reverted to Vo and Qo, respectively, substantially after these abrupt changes.

What we claim is:

1. In a process for direct chill casting of metals in a forced-cooling mold having a lubricating surface on the inner surface thereof comprising the steps of:

storing a metallic melt in a feed reservoir for the melt, above and adjacent said mold, said feed reservoir having an overhang over the inner wall of said mold;

feeding said melt from said feed reservoir into said mold;

holding a body of said metal within said mold; and passing a cooling agent through said mold thereby performing the forced cooling of said metal body;

an improvement which comprises the step of:

introducing a gas from directly below said overhang and applying gas pressure on the peripheral surface of said metal body at the part of said metal body directly below said overhang.

2. A process according to claim 1, wherein said gas pressure is predetermined between the pressure at which the gas ascends through said metallic melt and the pressure at which the area of contact of said metal body with the inner wall of said mold is substantially reduced due to the introduction of said gas.

3. A process according to claim 2, wherein said gas pressure is predetermined to be approximately equal to said hydrostatic pressure of said melt at a depth thereof equal to said overhang.

4. A process according to claim 3, wherein aluminum and its alloy is cast, and, further, wherein formation of the lubricating surface is performed by supplying a liquid lubricating agent to said inner wall of said mold.

5. A process according to claim 4, wherein said lubricating oil is supplied to said inner wall of said mold at a position on the mold below the introduction position of the gas.

6. A process according to claim 5, wherein pressure for supplying said lubricating oil is such that said this oil does not flow back due to gas pressure.

7. A process according to claim 6, wherein said pressure for supplying the lubricating oil is higher than said gas pressure by an amount from 10 to 50 mm $H_2O$.

8. A process according to claim 7, wherein the viscosity of said lubricating oil ranges from 1 to 50 poises at room temperature.

9. A process according to claim 4, further comprising the step of:

supplying said lubricating oil on an inner peripheral part of the top surface of said mold and subsequently to the inner wall of said mold.

10. A process according to claim 9, wherein the viscosity of said lubricating oil ranges from 1 to 50 poises at room temperature.

11. A process according to claim 9, herein flowing rate of said gas ranges from 0.2 to 5.0 liter/minute and supplying rate of said lubricating oil ranges from 0.1 to 1.2 mililiter/minute.

12. A process according to claim 4, wherein an improvement of which further comprises the steps of:

flowing said gas at a predetermined rate;

flowing said lubricating agent at a predetermined rate;

detecting the temperature of the inner wall of said mold;

increasing at least the rate of flowing said gas out of both the rate of flowing said gas and the rate of supplying said lubricating agent to a rate higher than the predetermined rate, when said detected temperature of the inner wall of said mold exceeds a predetermined temperature.

13. A process according to claim 12, wherein said process is performed during a steady casting stage.

14. A process according to claim 13, wherein said process further comprises the step of:

step wise decreasing said increased rate to the previous rate.

15. A process according to claim 14, wherein said decreasing step is initiated at a time when the increase in said detected temperature in reduced to zero.

16. A process according to claim 4, wherein an improvement of which further comprises the steps of:

flowing said gas at a predetermined rate;

flowing said lubricating agent at a predetermined rate;

detecting the temperature of the inner wall of said mold and the pressure of the gas at a position directly below said overhang;

increasing at least the rate of flowing said gas out of both the rate of flowing said gas and the rate of supplying said lubricating agent to a rate higher than the predetermined rate, when said detected temperature of said inner wall of said mold exceeds a predetermined temperature;

increasing at least the rate of flowing said gas out of both the rate for flowing said gas and the rate of supplying said lubricating agent to a rate higher than said predetermined rate, when said detected pressure exceeds a predetermined upper pressure; and decreasing said increased rate to a rate, lower than said predetermined rate, when said detected pressure decreases from a predetermined lower pressure.

17. A process according to claim 4, wherein an improvement of which further comprises the steps of:

flowing said gas at a predetermined rate;

flowing said lubricating agent at a predetermined rate;

detecting, at the initial stage of casting, the pressure of the gas at a position directly below said overhang; and increasing both the said rate of flowing said gas and said rate of supplying said lubricating agent to a rate higher than said predetermined rate, when said detected pressure is less than a predetermined pressure.

18. A process according to claim 17, wherein said process further comprises the step of:

step wise decreasing said increased rates to a rate predetermined for a steady casting stage.

* * * * *

UNITED STATES PATENT AND TRADEMARK OFFICE

CERTIFICATE OF CORRECTION

PATENT NO. : 4,157,728

DATED : June 12, 1979

INVENTOR(S) : RYOTA MITAMURA ET AL

It is certified that error appears in the above-identified patent and that said Letters Patent are hereby corrected as shown below:

On the cover page, Item [30], "Jun. 24, 1977 [JP] Japan ..... 52-77474" should be --- Jun. 24, 1977 [JP] Japan ..... 52-74474 ---.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*

REEXAMINATION CERTIFICATE (700th)

United States Patent [19] [11] B1 4,157,728

Mitamura et al. [45] Certificate Issued Jun. 9, 1987

[54] PROCESS FOR DIRECT CHILL CASTING OF METALS

[75] Inventors: Ryota Mitamura, Yokohama; Tadanao Itoh, Ichihara, both of Japan

[73] Assignee: Showa Denko Kabushiki Kaisha, Tokyo, Japan

Reexamination Request:
No. 90/000,936, Jan. 13, 1986
No. 90/001,052, Jul. 10, 1986

Reexamination Certificate for:

| | |
|---|---|
| Patent No.: | **4,157,728** |
| Issued: | **Jun. 12, 1979** |
| Appl. No.: | **820,535** |
| Filed: | **Jul. 29, 1977** |

Certificate of Correction issued Oct. 23, 1979.

[30] Foreign Application Priority Data

| | | | |
|---|---|---|---|
| Jul. 29, 1976 | [JP] | Japan | 51-89620 |
| Mar. 18, 1977 | [JP] | Japan | 52-29328 |
| Jun. 24, 1977 | [JP] | Japan | 52-77474 |

[51] Int. Cl.[4] ..... B22D 11/124; B22D 11/22

[52] U.S. Cl. ..... 164/452; 164/124; 164/126; 164/472; 164/487

[58] Field of Search ..... 164/487, 444, 475, 415, 164/452, 472

[56] References Cited

U.S. PATENT DOCUMENTS

| | | |
|---|---|---|
| 3,342,252 | 9/1967 | Wood et al. . |
| 3,381,741 | 5/1968 | Gardner . |
| 3,612,151 | 10/1971 | Harrington et al. . |
| 4,057,100 | 11/1977 | Lossack et al. . |

FOREIGN PATENT DOCUMENTS

| | | |
|---|---|---|
| 49-29226 | 3/1974 | Japan . |
| 50-84423 | 7/1975 | Japan . |
| 51-8123 | 1/1976 | Japan . |
| 856424 | 12/1960 | United Kingdom . |
| 1086094 | 10/1967 | United Kingdom . |

*Primary Examiner*—K. Y. Lin

[57] ABSTRACT

A direct chill casting of metals, particularly hot top casting of aluminum and its alloy, is improved by applying a gas pressure to the metals from directly below the overhang of a feed reservoir for receiving a melt to be cast.

The direct chill casting is further improved by supplying a lubricating oil from a slit for conveying the gas to the inner wall of the mold.

By using the process and the apparatus according to the invention, ingots having excellent smooth surfaces and reduced segregation can be reliably produced with a reduction in the amount of the lubricating oil used.

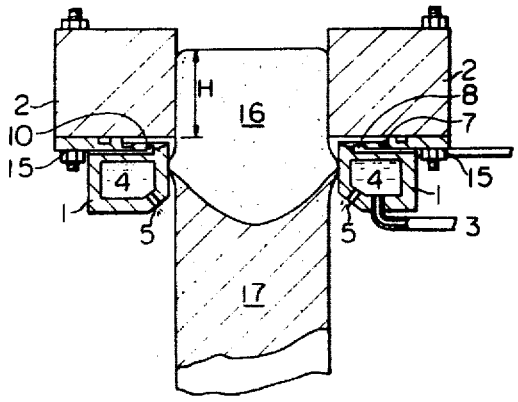

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-18, dependent on an amended claim, are determined to be patentable.

1. [In a] *A* process for direct chill casting of metals in a forced-cooling mold having a lubricating surface on the inner surface thereof comprising the steps of;

storing a metallic melt in a feed reservoir for the melt, above and adjacent said mold, said feed reservoir having an overhang over the inner wall of said mold;

feeding said melt from said feed reservoir into said mold;

holding a body of said metal within said mold; [and] *forming a level of said melt only within said feed reservoir;* passing a cooling agent through said mold thereby performing the forced cooling of said metal body; [an improvement which comprises the step of:]

introducing a gas directly below said overhang; and applying gas pressure on the peripheral surface of said metal body at the part of said metal body directly below said overhang *to reduce the area of contact of said metal body with the inner wall of said mold.*

* * * * *